US009961474B2

(12) United States Patent
Faller et al.

(10) Patent No.: US 9,961,474 B2
(45) Date of Patent: May 1, 2018

(54) AUDIO SIGNAL PROCESSING APPARATUS

(71) Applicant: Huawei Technologies Co., Ltd., Shenzhen (CN)

(72) Inventors: Christof Faller, Uster (CH); Alexis Favrot, Uster (CH); Yue Lang, Beijing (CN); Peter Grosche, Munich (DE)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days. days.

(21) Appl. No.: 15/362,275

(22) Filed: Nov. 28, 2016

(65) Prior Publication Data

US 2017/0078821 A1 Mar. 16, 2017

Related U.S. Application Data

(63) Continuation of application No. PCT/EP2014/067288, filed on Aug. 13, 2014.

(51) Int. Cl.

| | |
|---|---|
| ***H04S 7/00*** | (2006.01) |
| ***H04S 3/00*** | (2006.01) |
| ***H04S 1/00*** | (2006.01) |

(52) U.S. Cl.

CPC ..... *H04S 7/306* (2013.01); *H04S 1/002* (2013.01); *H04S 3/008* (2013.01); *H04S 2420/01* (2013.01)

(58) Field of Classification Search

CPC ..... H04S 3/008; H04S 7/306; H04S 1/002; H04S 2420/01

(Continued)

(56) References Cited

U.S. PATENT DOCUMENTS

2003/0044032 A1 3/2003 Irwan et al.
2005/0135643 A1* 6/2005 Lee ..... H04S 3/008 381/309

(Continued)

FOREIGN PATENT DOCUMENTS

CN 1552171 A 12/2004
CN 1630434 A 6/2005

(Continued)

OTHER PUBLICATIONS

Foreign Communication From a Counterpart Application, European Application No. 14766668.9, European Office Action dated Aug. 22, 2017, 6 pages.

(Continued)

*Primary Examiner* — Melur Ramakrishnaiah

(74) *Attorney, Agent, or Firm* — Conley Rose, P.C.

(57) ABSTRACT

The disclosure is based on the finding that acoustic near-field transfer functions indicating acoustic near-field propagation channels between loudspeakers and ears of a listener can be employed to pre-process audio signals. Therefore, acoustic near-field distortions of the audio signals can be mitigated. The pre-processed audio signals can be presented to the listener using a wearable frame, wherein the wearable frame comprises the loudspeakers for audio presentation. The disclosure can allow for a high quality rendering of audio signals as well as a high listening comfort for the listener. The disclosure can provide the following advantages. By means of a loudspeaker selection as a function of a spatial audio source direction, cues related to the listener's ears can be generated, making the approach more robust with regard to front/back confusion. The approach can further be extended to an arbitrary number of loudspeaker pairs.

14 Claims, 21 Drawing Sheets

(58) Field of Classification Search
USPC ..... 381/303, 309, 310, 17
See application file for complete search history.

(56) References Cited

U.S. PATENT DOCUMENTS

| | | | | |
|---|---|---|---|---|
| 2007/0067054 | A1* | 3/2007 | Danish | A47G 33/008 700/94 |
| 2007/0230725 | A1 | 10/2007 | Wang | |
| 2011/0286601 | A1 | 11/2011 | Fukui et al. | |

FOREIGN PATENT DOCUMENTS

| | | | |
|---|---|---|---|
| CN | 102325298 | A | 1/2012 |
| CN | 102572676 | A | 7/2012 |
| EP | 1545154 | A2 | 6/2005 |
| EP | 1775994 | A1 | 4/2007 |
| WO | 9730566 | A1 | 8/1997 |
| WO | 2006039748 | A1 | 4/2006 |

OTHER PUBLICATIONS

Bauer, B., "Phasor Analysis of Some Stereophonic Phenomena," IRE Transactions on Audio, Jan.-Feb. 1962, pp. 18-21.
Blauert, J., "Communication Acoustics," Springer, 2005, 385 pages.
Duda, R., et al., "Range dependence of the reponse of a spherical head model," Acoustical Society of America, 1998, 11 pages.
"Near-Field, Elevation, and Front-Rear Separation Effects for Headphones," Nov. 12, 2013, 16 pages.
Foreign Communication From a Counterpart Application, PCT Application No. PCT/EP2014/067288, International Search Report dated Apr. 30, 2015, 4 pages.
Machine Translation and Abstract of Chinese Publication No. CN102572676, dated Jul. 11, 2012, 23 pages.
Foreign Communication From a Counterpart Application, Chinese Application No. 2014800811052, Chinese Search Report dated Dec. 7, 2017, 2 pages.
Foreign Communication From a Counterpart Application, Chinese Application No. 2014800811052, Chinese Office Action dated Jan. 11, 2018, 8 pages.

* cited by examiner

AUDIO SIGNAL PROCESSING APPARATUS

CROSS-REFERENCE TO RELATED APPLICATIONS

This application is a continuation of international patent application number PCT/EP2014/067288 filed on Aug. 13, 2014, which is incorporated by reference.

TECHNICAL FIELD

The present disclosure relates to the field of audio signal processing, in particular to the field of rendering audio signals for audio perception by a listener.

BACKGROUND

The rendering of audio signals for audio perception by a listener using wearable devices can be achieved using headphones connected to the wearable device. Headphones can provide the audio signals directly to the auditory system of the listener and can therefore provide an adequate audio quality. However, headphones represent a second independent device which the listener needs to put into or onto his ears. This can reduce the comfort when using the wearable device. This disadvantage can be mitigated by integrating the rendering of the audio signals into the wearable device.

Bone conduction can, e.g., be used for this purpose wherein bone conduction transducers can be mounted behind the ears of the listener. Therefore, the audio signals can be conducted through the bones directly into the inner ears of the listener. However, as this approach does not produce sound waves in the ear canals, it may not be able to create a natural listening experience in terms of audio quality or spatial audio perception. In particular, high frequencies may not be conducted through the bones and may therefore be attenuated. Furthermore, the audio signal conducted at the left ear side may also travel to the right ear side through the bones and vice versa. This crosstalk effect can interfere with binaural localization of spatial audio sources.

The described approaches for audio rendering of audio signals using wearable devices constitute a trade-off between listening comfort and audio quality. Headphones can allow for an adequate audio quality but can lead to a reduced listening comfort. Bone conduction may be convenient but can lead to a reduced audio quality.

SUMMARY

It is the object of the disclosure to provide an improved concept for rendering audio signals for audio perception by a listener.

This object is achieved by the features of the independent claims. Further implementation forms are apparent from the dependent claims, the description and the figures.

The disclosure is based on the finding that acoustic near-field transfer functions indicating acoustic near-field propagation channels between loudspeakers and ears of a listener can be employed to pre-process the audio signals. Therefore, acoustic near-field distortions of the audio signals can be mitigated. The pre-processed audio signals can be presented to the listener using a wearable frame, wherein the wearable frame comprises the loudspeakers for audio presentation. The disclosure can allow for a high quality rendering of audio signals as well as a high listening comfort for the listener.

According to a first aspect, the disclosure relates to an audio signal processing apparatus for pre-processing a first input audio signal to obtain a first output audio signal and for pre-processing a second input audio signal to obtain a second output audio signal, the first output audio signal to be transmitted over a first acoustic near-field propagation channel between a first loudspeaker and a left ear of a listener, the second output audio signal to be transmitted over a second acoustic near-field propagation channel between a second loudspeaker and a right ear of the listener, the audio signal processing apparatus comprising a provider being configured to provide a first acoustic near-field transfer function of the first acoustic near-field propagation channel between the first loudspeaker and the left ear of the listener, and to provide a second acoustic near-field transfer function of the second acoustic near-field propagation channel between the second loudspeaker and the right ear of the listener, and a filter being configured to filter the first input audio signal upon the basis of an inverse of the first acoustic near-field transfer function to obtain the first output audio signal, the first output audio signal being independent of the second input audio signal, and to filter the second input audio signal upon the basis of an inverse of the second acoustic near-field transfer function to obtain the second output audio signal, the second output audio signal being independent of the first input audio signal. Thus, an improved concept for rendering audio signals for audio perception by a listener can be provided.

The pre-processing of the first input audio signal and the second input audio signal can also be considered or referred to as pre-distorting of the first input audio signal and the second input audio signal, due to the filtering or modification of the first input audio signal and second input audio signal.

A first acoustic crosstalk transfer function indicating a first acoustic crosstalk propagation channel between the first loudspeaker and the right ear of the listener, and a second acoustic crosstalk transfer function indicating a second acoustic crosstalk propagation channel between the second loudspeaker and the left ear of the listener can be considered to be zero. No crosstalk cancellation technique may be applied.

In a first implementation form of the apparatus according to the first aspect as such, the provider comprises a memory for providing the first acoustic near-field transfer function or the second acoustic near-field transfer function, wherein the provider is configured to retrieve the first acoustic near-field transfer function or the second acoustic near-field transfer function from the memory to provide the first acoustic near-field transfer function or the second acoustic near-field transfer function. Thus, the first acoustic near-field transfer function or the second acoustic near-field transfer function can be provided efficiently.

The first acoustic near-field transfer function or the second acoustic near-field transfer function can be predetermined and can be stored in the memory.

In a second implementation form of the apparatus according to the first aspect as such or any preceding implementation form of the first aspect, the provider is configured to determine the first acoustic near-field transfer function of the first acoustic near-field propagation channel upon the basis of a location of the first loudspeaker and a location of the left ear of the listener, and to determine the second acoustic near-field transfer function of the second acoustic near-field propagation channel upon the basis of a location of the second loudspeaker and a location of the right ear of the listener. Thus, the first acoustic near-field transfer function or the second acoustic near-field transfer function can be provided efficiently.

The determined first acoustic near-field transfer function or second acoustic near-field transfer function can be determined once and can be stored in the memory of the provider.

In a third implementation form of the apparatus according to the first aspect as such or any preceding implementation form of the first aspect, the filter is configured to filter the first input audio signal or the second input audio signal according to the following equations:

$$X_L(j\omega) = \frac{E_L(j\omega)}{G_{LL}(j\omega)} \text{ and } X_R(j\omega) = \frac{E_R(j\omega)}{G_{RR}(j\omega)}. \quad (1)$$

wherein $E_L$ denotes the first input audio signal, $E_R$ denotes the second input audio signal, $X_L$ denotes the first output audio signal, $X_R$ denotes the second output audio signal, $G_{LL}$ denotes the first acoustic near-field transfer function, $G_{RR}$ denotes the second acoustic near-field transfer function, ω denotes an angular frequency, and j denotes an imaginary unit. Thus, the filtering of the first input audio signal or the second input audio signal can be performed efficiently.

The filtering of the first input audio signal or the second input audio signal can be performed in frequency domain or in time domain.

In a fourth implementation form of the apparatus according to the first aspect as such or any preceding implementation form of the first aspect, the apparatus comprises a further filter being configured to filter a source audio signal upon the basis of a first acoustic far-field transfer function to obtain the first input audio signal, and to filter the source audio signal upon the basis of a second acoustic far-field transfer function to obtain the second input audio signal. Thus, acoustic far-field effects can be considered efficiently.

In a fifth implementation form of the apparatus according to the fourth implementation form of the first aspect, the source audio signal is associated to a spatial audio source within a spatial audio scenario, wherein the further filter is configured to determine the first acoustic far-field transfer function upon the basis of a location of the spatial audio source within the spatial audio scenario and a location of the left ear of the listener, and to determine the second acoustic far-field transfer function upon the basis of the location of the spatial audio source within the spatial audio scenario and a location of the right ear of the listener. Thus, a spatial audio source within a spatial audio scenario can be considered.

In a sixth implementation form of the apparatus according to the fourth implementation form or the fifth implementation form of the first aspect, the first acoustic far-field transfer function or the second acoustic far-field transfer function is a head related transfer function. Thus, the first acoustic far-field transfer function or the second acoustic far-field transfer function can be modelled efficiently.

The first acoustic far-field transfer function and the second acoustic far-field transfer function can be head related transfer functions (HRTFs) which can be prototypical HRTFs measured using a dummy head, individual HRTFs measured from a particular person, or model based HRTFs which can be synthesized based on a model of a prototypical human head.

In a seventh implementation form of the apparatus according to the fifth implementation form or the sixth implementation form of the first aspect, the filter is further configured to determine the first acoustic far-field transfer function or the second acoustic far-field transfer function upon the basis of the location of the spatial audio source within the spatial audio scenario according to the following equations:

$$\Gamma(\rho, \mu, \theta, \phi) = -\frac{\rho}{\mu} e^{-j\mu\rho} \sum_{m=0}^{\infty} (2m+1) P_m \cos\theta \frac{h_m(\mu\rho)}{h'_m(\mu)} \quad (2)$$

$$\rho = \frac{r}{a}, \quad (3)$$

$$\mu = \frac{2af}{c}, \quad (4)$$

wherein Γ denotes the first acoustic far-field transfer function or the second acoustic far-field transfer function, $P_m$ denotes a Legendre polynomial of degree m, $h_m$ denotes an $m^{th}$ order spherical Hankel function, $h'_m$ denotes a first derivative of $h_m$, ρ denotes a normalized distance, r denotes a range, α denotes a radius, μ denotes a normalized frequency, f denotes a frequency, c denotes a celerity of sound, θ denotes an azimuth angle, and ϕ denotes an elevation angle. Thus, the first acoustic far-field transfer function or the second acoustic far-field transfer function can be determined efficiently.

The equations relate to a model based head related transfer function as a specific model or form of a general head related transfer function.

In an eighth implementation form of the apparatus according to the fifth implementation form to the seventh implementation form of the first aspect, the apparatus comprises a weighter being configured to weight the first output audio signal or the second output audio signal by a weighting factor, wherein the weighter is configured to determine the weighting factor upon the basis of a distance between the spatial audio source and the listener. Thus, the distance between the spatial audio source and the listener can be considered efficiently.

In a ninth implementation form of the apparatus according to the eighth implementation form of the first aspect, the weighter is configured to determine the weighting factor according to the following equation:

$$g(\rho) = \left(\frac{r_0}{r}\right)^{\alpha} = \left(\frac{r_0}{a\rho}\right)^{\alpha}, \quad (5)$$

wherein g denotes the weighting factor, ρ denotes a normalized distance, r denotes a range, $r_0$ denotes a reference range, α denotes a radius, and α denotes an exponent parameter. Thus, the weighting factor can be determined efficiently.

In a tenth implementation form of the apparatus according to the fifth implementation form to the ninth implementation form of the first aspect, the apparatus comprises a selector being configured to select the first loudspeaker from a first pair of loudspeakers and to select the second loudspeaker from a second pair of loudspeakers, wherein the selector is configured to determine an azimuth angle or an elevation angle of the spatial audio source with regard to a location of the listener, and wherein the selector is configured to select the first loudspeaker from the first pair of loudspeakers and to select the second loudspeaker from the second pair of loudspeakers upon the basis of the determined azimuth angle or elevation angle of the spatial audio source. Thus, an acoustic front-back or elevation confusion effect can be mitigated efficiently.

In an eleventh implementation form of the apparatus according to the tenth implementation form of the first aspect, the selector is configured to compare a first pair of azimuth angles or a first pair of elevation angles of the first pair of loudspeakers with the azimuth angle or the elevation angle of the spatial audio source to select the first loudspeaker, and to compare a second pair of azimuth angles or a second pair of elevation angles of the second pair of loudspeakers with the azimuth angle or the elevation angle of the spatial audio source to select the second loudspeaker. Thus, the first loudspeaker and the second loudspeaker can be selected efficiently.

The comparison can comprise a minimization of an angular difference or distance between angles of the loudspeakers and an angle of the spatial audio source with regard to a position of the listener. The first pair of angles and/or the second pair of angles can be provided by the provider. The first pair of angles and/or the second pair of angles can e.g. be retrieved from the memory of the provider.

According to a second aspect, the disclosure relates to an audio signal processing method for pre-processing a first input audio signal to obtain a first output audio signal and for pre-processing a second input audio signal to obtain a second output audio signal, the first output audio signal to be transmitted over a first acoustic near-field propagation channel between a first loudspeaker and a left ear of a listener, the second output audio signal to be transmitted over a second acoustic near-field propagation channel between a second loudspeaker and a right ear of the listener, the audio signal processing method comprising providing a first acoustic near-field transfer function of the first acoustic near-field propagation channel between the first loudspeaker and the left ear of the listener, providing a second acoustic near-field transfer function of the second acoustic near-field propagation channel between the second loudspeaker and the right ear of the listener, filtering the first input audio signal upon the basis of an inverse of the first acoustic near-field transfer function to obtain the first output audio signal, the first output audio signal being independent of the second input audio signal, and filtering the second input audio signal upon the basis of an inverse of the second acoustic near-field transfer function to obtain the second output audio signal, the second output audio signal being independent of the first input audio signal. Thus, an improved concept for rendering audio signals for audio perception by a listener can be provided.

The audio signal processing method can be performed by the audio signal processing apparatus. Further features of the audio signal processing method directly result from the functionality of the audio signal processing apparatus.

In a first implementation form of the method according to the second aspect as such, the method comprises retrieving the first acoustic near-field transfer function or the second acoustic near-field transfer function from a memory to provide the first acoustic near-field transfer function or the second acoustic near-field transfer function. Thus, the first acoustic near-field transfer function or the second acoustic near-field transfer function can be provided efficiently.

In a second implementation form of the method according to the second aspect as such or any preceding implementation form of the second aspect, the method comprises determining the first acoustic near-field transfer function of the first acoustic near-field propagation channel upon the basis of a location of the first loudspeaker and a location of the left ear of the listener, and determining the second acoustic near-field transfer function of the second acoustic near-field propagation channel upon the basis of a location of the second loudspeaker and a location of the right ear of the listener. Thus, the first acoustic near-field transfer function or the second acoustic near-field transfer function can be provided efficiently.

In a third implementation form of the method according to the second aspect as such or any preceding implementation form of the second aspect, the method comprises filtering the first input audio signal or the second input audio signal according to the following equations:

$$X_L(j\omega) = \frac{E_L(j\omega)}{G_{LL}(j\omega)} \text{ and } X_R(j\omega) = \frac{E_R(j\omega)}{G_{RR}(j\omega)}. \tag{6}$$

wherein $E_L$ denotes the first input audio signal, $E_R$ denotes the second input audio signal, $X_L$ denotes the first output audio signal, $X_R$ denotes the second output audio signal, $G_{LL}$ denotes the first acoustic near-field transfer function, $G_{RR}$ denotes the second acoustic near-field transfer function, ω denotes an angular frequency, and j denotes an imaginary unit. Thus, the filtering of the first input audio signal or the second input audio signal can be performed efficiently.

In a fourth implementation form of the method according to the second aspect as such or any preceding implementation form of the second aspect, the method comprises filtering a source audio signal upon the basis of a first acoustic far-field transfer function to obtain the first input audio signal, and filtering the source audio signal upon the basis of a second acoustic far-field transfer function to obtain the second input audio signal. Thus, acoustic far-field effects can be considered efficiently.

In a fifth implementation form of the method according to the fourth implementation form of the second aspect, the source audio signal is associated to a spatial audio source within a spatial audio scenario, wherein the method comprises determining the first acoustic far-field transfer function upon the basis of a location of the spatial audio source within the spatial audio scenario and a location of the left ear of the listener, and determining the second acoustic far-field transfer function upon the basis of the location of the spatial audio source within the spatial audio scenario and a location of the right ear of the listener. Thus, a spatial audio source within a spatial audio scenario can be considered.

In a sixth implementation form of the method according to the fourth implementation form or the fifth implementation form of the second aspect, the first acoustic far-field transfer function or the second acoustic far-field transfer function is a head related transfer function. Thus, the first acoustic far-field transfer function or the second acoustic far-field transfer function can be modelled efficiently.

In a seventh implementation form of the method according to the fifth implementation form or the sixth implementation form of the second aspect, the method comprises determining the first acoustic far-field transfer function or the second acoustic far-field transfer function upon the basis of the location of the spatial audio source within the spatial audio scenario according to the following equations:

$$\Gamma(\rho, \mu, \theta, \phi) = -\frac{\rho}{\mu} e^{-j\mu\rho} \sum_{m=0}^{\infty} (2m+1) P_m \cos\theta \frac{h_m(\mu\rho)}{h'_m(\mu)} \tag{7}$$

$$\rho = \frac{r}{a},$$

$$\mu = \frac{2af}{c},$$

wherein Γ denotes the first acoustic far-field transfer function or the second acoustic far-field transfer function, $P_m$ denotes a Legendre polynomial of degree m, $h_m$ denotes an $m^{th}$ order spherical Hankel function, $h'_m$ denotes a first derivative of $h_m$, ρ denotes a normalized distance, r denotes a range, α denotes a radius, μ denotes a normalized frequency, f denotes a frequency, c denotes a celerity of sound, θ denotes an azimuth angle, and ϕ denotes an elevation angle. Thus, the first acoustic far-field transfer function or the second acoustic far-field transfer function can be determined efficiently.

In an eighth implementation form of the method according to the fifth implementation form to the seventh implementation form of the second aspect, the method comprises weighting the first output audio signal or the second output audio signal by a weighting factor, and determining the weighting factor upon the basis of a distance between the spatial audio source and the listener. Thus, the distance between the spatial audio source and the listener can be considered efficiently.

In a ninth implementation form of the method according to the eighth implementation form of the second aspect, the method comprises determining the weighting factor according to the following equation:

$$g(\rho) = \left(\frac{r_0}{r}\right)^a = \left(\frac{r_0}{a\rho}\right)^a, \tag{8}$$

wherein g denotes the weighting factor, ρ denotes a normalized distance, r denotes a range, $r_0$ denotes a reference range, α denotes a radius, and a denotes an exponent parameter. Thus, the weighting factor can be determined efficiently.

In a tenth implementation form of the method according to the fifth implementation form to the ninth implementation form of the second aspect, the method comprises determining an azimuth angle or an elevation angle of the spatial audio source with regard to a location of the listener, and selecting the first loudspeaker from a first pair of loudspeakers and selecting the second loudspeaker from a second pair of loudspeakers upon the basis of the determined azimuth angle or elevation angle of the spatial audio source. Thus, an acoustic front-back confusion effect can be mitigated efficiently.

In an eleventh implementation form of the method according to the tenth implementation form of the second aspect, the method comprises comparing a first pair of azimuth angles or a first pair of elevation angles of the first pair of loudspeakers with the azimuth angle or the elevation angle of the spatial audio source to select the first loudspeaker, and comparing a second pair of azimuth angles or a second pair of elevation angles of the second pair of loudspeakers with the azimuth angle or the elevation angle of the spatial audio source to select the second loudspeaker. Thus, the first loudspeaker and the second loudspeaker can be selected efficiently.

According to a third aspect, the disclosure relates to a provider for providing a first acoustic near-field transfer function of a first acoustic near-field propagation channel between a first loudspeaker and a left ear of a listener and for providing a second acoustic near-field transfer function of a second acoustic near-field propagation channel between a second loudspeaker and a right ear of the listener, the provider comprising a processor being configured to determine the first acoustic near-field transfer function upon the basis of a location of the first loudspeaker and a location of the left ear of the listener, and to determine the second acoustic near-field transfer function upon the basis of a location of the second loudspeaker and a location of the right ear of the listener. Thus, an improved concept for rendering audio signals for audio perception by a listener can be provided.

The provider can be used in conjunction with the apparatus according to the first aspect as such or any implementation form of the first aspect.

In a first implementation form of the provider according to the third aspect as such, the processor is configured to determine the first acoustic near-field transfer function upon the basis of a first head related transfer function indicating the first acoustic near-field propagation channel in dependence of the location of the first loudspeaker and the location of the left ear of the listener, and to determine the second acoustic near-field transfer function upon the basis of a second head related transfer function indicating the second acoustic near-field propagation channel in dependence of the location of the second loudspeaker and the location of the right ear of the listener. Thus, the first acoustic near-field transfer function and the second acoustic near-field transfer function can be determined efficiently.

The first head related transfer function or the second head related transfer function can be general head related transfer functions.

In a second implementation form of the provider according to the first implementation form of the third aspect, the processor is configured to determine the first acoustic near-field transfer function or the second acoustic near-field transfer function according to the following equations:

$$G_{LL}(j\omega) = \Gamma^L_{NF}(\rho, \mu, \theta, \phi) \text{ with } \Gamma^L_{NF}(\rho, \mu, \theta, \phi) = \frac{\Gamma^L(\rho, \mu, \theta, \phi)}{\Gamma^L(\infty, \mu, \theta, \phi)}, \tag{9}$$

$$G_{RR}(j\omega) = \Gamma^R_{NF}(\rho, \mu, \theta, \phi) \text{ with } \Gamma^R_{NF}(\rho, \mu, \theta, \phi) = \frac{\Gamma^R(\rho, \mu, \theta, \phi)}{\Gamma^R(\infty, \mu, \theta, \phi)}, \tag{10}$$

$$\Gamma(\rho, \mu, \theta, \phi) = -\frac{\rho}{\mu} e^{-j\mu\rho} \sum_{m=0}^{\infty} (2m+1) P_m \cos\theta \frac{h_m(\mu\rho)}{h'_m(\mu)} \tag{11}$$

$$\rho = \frac{r}{a}, \tag{12}$$

$$\mu = \frac{2af}{c}, \tag{13}$$

wherein $G_{LL}$ denotes the first acoustic near-field transfer function, $G_{RR}$ denotes the second acoustic near-field transfer function, $\Gamma^L$ denotes the first head related transfer function, $\Gamma^R$ denotes the second head related transfer function, ω denotes an angular frequency, j denotes an imaginary unit, $P_m$ denotes a Legendre polynomial of degree m, $h_m$ denotes an $m^{th}$ order spherical Hankel function, $h'_m$ denotes a first derivative of $h_m$, ρ denotes a normalized distance, r denotes a range, α denotes a radius, μ denotes a normalized frequency, f denotes a frequency, c denotes a celerity of sound, θ denotes an azimuth angle, and ϕ denotes an elevation angle. Thus, the first acoustic near-field transfer function or the second acoustic near-field transfer function can be determined efficiently.

The equations relate to a model based head related transfer function as a specific model or form of a general head related transfer function.

According to a fourth aspect, the disclosure relates to a method for providing a first acoustic near-field transfer function of a first acoustic near-field propagation channel between a first loudspeaker and a left ear of a listener and for providing a second acoustic near-field transfer function of a second acoustic near-field propagation channel between a second loudspeaker and a right ear of the listener, the method comprising determining the first acoustic near-field transfer function upon the basis of a location of the first loudspeaker and a location of the left ear of the listener, and determining the second acoustic near-field transfer function upon the basis of a location of the second loudspeaker and a location of the right ear of the listener. Thus, an improved concept for rendering audio signals for audio perception by a listener can be provided.

The method can be performed by the provider. Further features of the method directly result from the functionality of the provider.

In a first implementation form of the method according to the fourth aspect as such, the method comprises determining the first acoustic near-field transfer function upon the basis of a first head related transfer function indicating the first acoustic near-field propagation channel in dependence of the location of the first loudspeaker and the location of the left ear of the listener, and determining the second acoustic near-field transfer function upon the basis of a second head related transfer function indicating the second acoustic near-field propagation channel in dependence of the location of the second loudspeaker and the location of the right ear of the listener. Thus, the first acoustic near-field transfer function and the second acoustic near-field transfer function can be determined efficiently.

In a second implementation form of the method according to the first implementation form of the fourth aspect, the method comprises determining the first acoustic near-field transfer function or the second acoustic near-field transfer function according to the following equations:

$$G_{LL}(j\omega)\Gamma^{L}_{NF}(\rho, \mu, \theta, \phi) \text{ with} \quad (14)$$

$$\Gamma^{L}_{NF}(\rho, \mu, \theta, \phi) = \frac{\Gamma^{L}(\rho, \mu, \theta, \phi)}{\Gamma^{L}(\infty, \mu, \theta, \phi)},$$

$$G_{RR}(j\omega) = \Gamma^{R}_{NF}(\rho, \mu, \theta, \phi) \text{ with} \quad (15)$$

$$\Gamma^{R}_{NF}(\rho, \mu, \theta, \phi) = \frac{\Gamma^{R}(\rho, \mu, \theta, \phi)}{\Gamma^{R}(\infty, \mu, \theta, \phi)},$$

$$\Gamma(\rho, \mu, \theta, \phi) = -\frac{\rho}{\mu}e^{-j\mu\rho}\sum_{m=0}^{\infty}(2m+1)P_m\cos\theta\frac{h_m(\mu\rho)}{h'_m(\mu)} \quad (16)$$

$$\rho = \frac{r}{a} \quad (17)$$

$$\mu = \frac{2af}{c}, \quad (18)$$

wherein $G_{LL}$ denotes the first acoustic near-field transfer function, $G_{RR}$ denotes the second acoustic near-field transfer function, $\Gamma^{L}$ denotes the first head related transfer function, $\Gamma^{R}$ denotes the second head related transfer function, ω denotes an angular frequency, j denotes an imaginary unit, $P_m$ denotes a Legendre polynomial of degree m, $h_m$ denotes an $m^{th}$ order spherical Hankel function, $h'_m$ denotes a first derivative of $h_m$, ρ denotes a normalized distance, r denotes a range, α denotes a radius, μ denotes a normalized frequency, f denotes a frequency, c denotes a celerity of sound, θ denotes an azimuth angle, and ϕ denotes an elevation angle. Thus, the first acoustic near-field transfer function or the second acoustic near-field transfer function can be determined efficiently.

According to a fifth aspect, the disclosure relates to a wearable frame being wearable by a listener, the wearable frame comprising the audio signal processing apparatus according to the first aspect as such or any implementation form of the first aspect, the audio signal processing apparatus being configured to pre-process a first input audio signal to obtain a first output audio signal and to pre-process a second input audio signal to obtain a second output audio signal, a first leg comprising a first loudspeaker, the first loudspeaker being configured to emit the first output audio signal towards a left ear of the listener, and a second leg comprising a second loudspeaker, the second loudspeaker being configured to emit the second output audio signal towards a right ear of the listener. Thus, an improved concept for rendering audio signals for audio perception by a listener can be provided.

In a first implementation form of the wearable frame according to the fifth aspect as such, the first leg comprises a first pair of loudspeakers, wherein the audio signal processing apparatus is configured to select the first loudspeaker from the first pair of loudspeakers, wherein the second leg comprises a second pair of loudspeakers, and wherein the audio signal processing apparatus is configured to select the second loudspeaker from the second pair of loudspeakers. Thus, an acoustic front-back confusion effect can be mitigated efficiently.

In a second implementation form of the wearable frame according to the fifth aspect as such or the first implementation form of the fifth aspect, the audio signal processing apparatus comprises a provider for providing a first acoustic near-field transfer function of a first acoustic near-field propagation channel between the first loudspeaker and the left ear of the listener and for providing a second acoustic near-field transfer function of a second acoustic near-field propagation channel between the second loudspeaker and the right ear of the listener according to the third aspect as such or any implementation form of the third aspect. Thus, the first acoustic near-field transfer function and the second acoustic near-field transfer function can be provided efficiently.

According to a sixth aspect, the disclosure relates to a computer program comprising a program code for performing the method according to the second aspect as such, any implementation form of the second aspect, the fourth aspect as such, or any implementation form of the fourth aspect when executed on a computer. Thus, the methods can be performed in an automatic and repeatable manner.

The audio signal processing apparatus and/or the provider can be programmably arranged to perform the computer program.

The disclosure can be implemented in hardware and/or software.

BRIEF DESCRIPTION OF DRAWINGS

Further implementation forms of the disclosure will be described with respect to the following figures, in which.

DETAILED DESCRIPTION OF EMBODIMENTS

Figure 1:
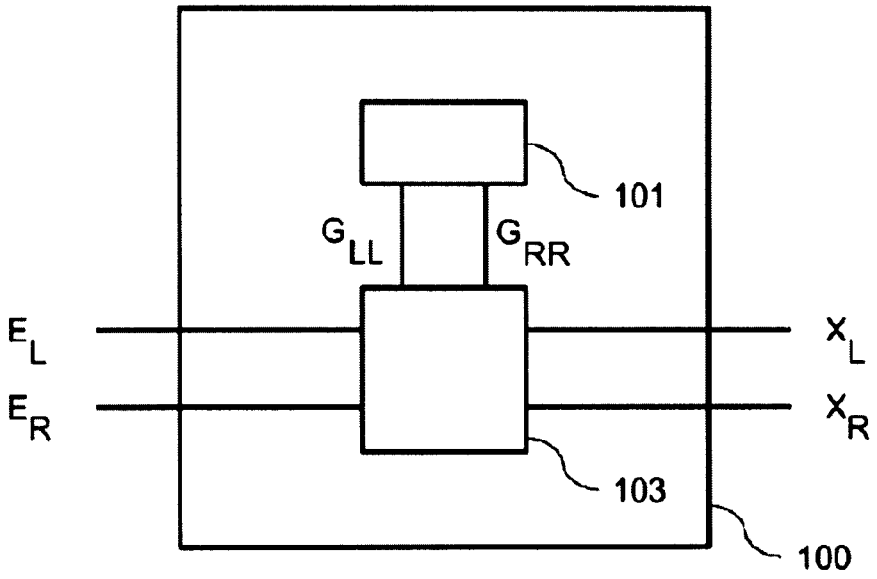
FIG. 1 shows a diagram of an audio signal processing apparatus for pre-processing a first input audio signal to obtain a first output audio signal and for pre-processing a second input audio signal to obtain a second output audio signal according to an implementation form.

FIG. 1 shows an audio signal processing apparatus 100 for pre-processing a first input audio signal $E_L$ to obtain a first output audio signal $X_L$ and for pre-processing a second input audio signal $E_R$ to obtain a second output audio signal $X_R$ according to an implementation form.

The first output audio signal $X_L$ is to be transmitted over a first acoustic near-field propagation channel between a first loudspeaker and a left ear of a listener. The second output audio signal $X_R$ is to be transmitted over a second acoustic near-field propagation channel between a second loudspeaker and a right ear of the listener.

The audio signal processing apparatus 100 comprises a provider 101 being configured to provide a first acoustic near-field transfer function $G_{LL}$ of the first acoustic near-field propagation channel between the first loudspeaker and the left ear of the listener, and to provide a second acoustic near-field transfer function $G_{RR}$ of the second acoustic near-field propagation channel between the second loudspeaker and the right ear of the listener, and a filter 103 being configured to filter the first input audio signal $E_L$ upon the basis of an inverse of the first acoustic near-field transfer function $G_{LL}$ to obtain the first output audio signal $X_L$, the first output audio signal $X_L$ being independent of the second input audio signal $E_R$, and to filter the second input audio signal $E_R$ upon the basis of an inverse of the second acoustic near-field transfer function $G_{RR}$ to obtain the second output audio signal $X_R$, the second output audio signal $X_R$ being independent of the first input audio signal $E_L$.

The provider 101 can comprise a memory for providing the first acoustic near-field transfer function $G_{LL}$ or the second acoustic near-field transfer function $G_{RR}$. The provider 101 can be configured to retrieve the first acoustic near-field transfer function $G_{LL}$ or the second acoustic near-field transfer function $G_{RR}$ from the memory to provide the first acoustic near-field transfer function $G_{LL}$ or the second acoustic near-field transfer function $G_{RR}$.

The provider 101 can further be configured to determine the first acoustic near-field transfer function $G_{LL}$ of the first acoustic near-field propagation channel upon the basis of a location of the first loudspeaker and a location of the left ear of the listener, and to determine the second acoustic near-field transfer function $G_{RR}$ of the second acoustic near-field propagation channel upon the basis of a location of the second loudspeaker and a location of the right ear of the listener.

The audio signal processing apparatus 100 can further comprise a further filter being configured to filter a source audio signal upon the basis of a first acoustic far-field transfer function to obtain the first input audio signal $E_L$, and to filter the source audio signal upon the basis of a second acoustic far-field transfer function to obtain the second input audio signal $E_R$.

The audio signal processing apparatus 100 can further comprise a weighter being configured to weight the first output audio signal $X_L$ or the second output audio signal $X_R$ by a weighting factor. The weighter can be configured to determine the weighting factor upon the basis of a distance between a spatial audio source and the listener.

The audio signal processing apparatus 100 can further comprise a selector being configured to select the first loudspeaker from a first pair of loudspeakers and to select the second loudspeaker from a second pair of loudspeakers. The selector can be configured to determine an azimuth angle or an elevation angle of a spatial audio source with regard to a location of the listener, and to select the first loudspeaker from the first pair of loudspeakers and to select the second loudspeaker from the second pair of loudspeakers upon the basis of the determined azimuth angle or elevation angle of the spatial audio source.

The first output audio signal $X_L$ can be independent of the second acoustic near-field transfer function $G_{RR}$. The second output audio signal $X_R$ can be independent of the first acoustic near-field transfer function $G_{LL}$.

The first output audio signal $X_L$ can be independent of the second input audio signal $E_R$ due to an assumption that a first acoustic crosstalk transfer function $G_{LR}$ is zero. The second output audio signal $X_R$ can be independent of the first input audio signal $E_L$ due to an assumption that a second acoustic crosstalk transfer function $G_{RL}$, is zero.

The first input audio signal $E_L$ can be filtered independently of the acoustic crosstalk transfer functions $G_{LR}$ and $G_{RL}$. The second input audio signal $E_R$ can be filtered independently of the acoustic crosstalk transfer functions $G_{LR}$ and $G_{RL}$.

The first output audio signal $X_L$ can be obtained independently of the second input audio signal $E_R$. The second output audio signal $X_R$ can be obtained independently of the first input audio signal $E_L$.

Figure 2:
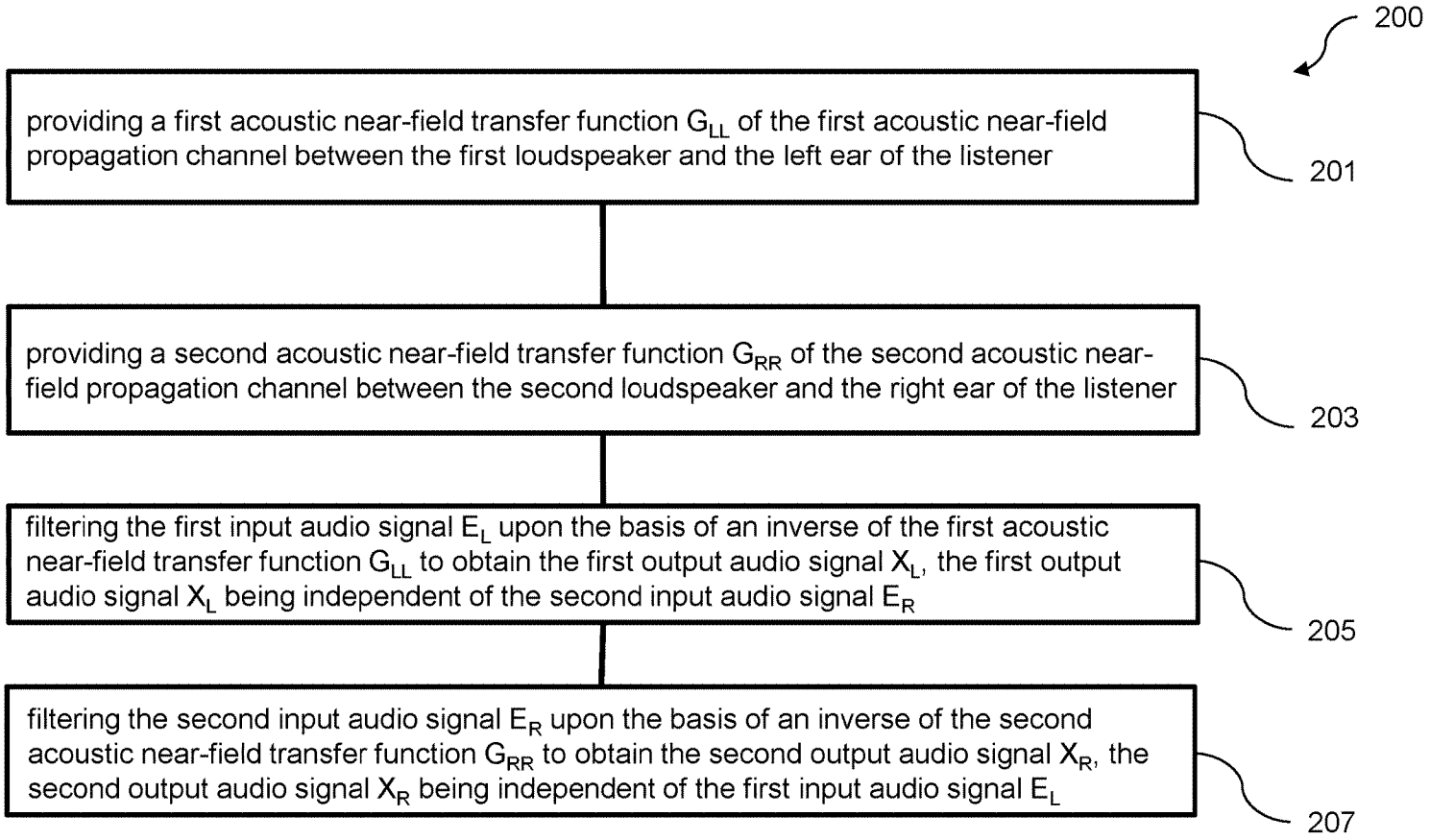
FIG. 2 shows a diagram of an audio signal processing method for pre-processing a first input audio signal to obtain a first output audio signal and for pre-processing a second input audio signal to obtain a second output audio signal according to an implementation form.

FIG. 2 shows a diagram of an audio signal processing method 200 for pre-processing a first input audio signal $E_L$ to obtain a first output audio signal $X_L$ and for pre-processing a second input audio signal $E_R$ to obtain a second output audio signal $X_R$ according to an implementation form.

The first output audio signal $X_L$ is to be transmitted over a first acoustic near-field propagation channel between a first loudspeaker and a left ear of a listener. The second output audio signal $X_R$ is to be transmitted over a second acoustic near-field propagation channel between a second loudspeaker and a right ear of the listener.

The audio signal processing method 200 comprises providing 201 a first acoustic near-field transfer function $G_{LL}$ of the first acoustic near-field propagation channel between the first loudspeaker and the left ear of the listener, providing 203 a second acoustic near-field transfer function $G_{RR}$ of the second acoustic near-field propagation channel between the second loudspeaker and the right ear of the listener, filtering 205 the first input audio signal $E_L$ upon the basis of an inverse of the first acoustic near-field transfer function $G_{LL}$ to obtain the first output audio signal $X_L$, the first output audio signal $X_L$ being independent of the second input audio signal $E_R$, and filtering 207 the second input audio signal $E_R$ upon the basis of an inverse of the second acoustic near-field transfer function $G_{RR}$ to obtain the second output audio signal $X_R$, the second output audio signal $X_R$ being independent of the first input audio signal $E_L$. The audio signal processing method 200 can be performed by the audio signal processing apparatus 100.

Figure 3:
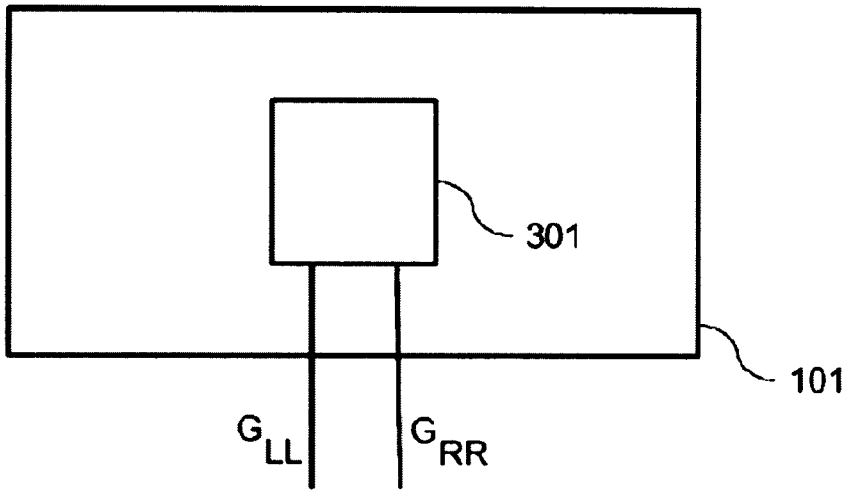
FIG. 3 shows a diagram of a provider for providing a first acoustic near-field transfer function of a first acoustic near-field propagation channel between a first loudspeaker and a left ear of a listener and for providing a second acoustic near-field transfer function of a second acoustic near-field propagation channel between a second loudspeaker and a right ear of the listener according to an implementation form.

FIG. 3 shows a diagram of a provider 101 for providing a first acoustic near-field transfer function $G_{LL}$ of a first acoustic near-field propagation channel between a first loudspeaker and a left ear of a listener and for providing a second acoustic near-field transfer function $G_{RR}$ of a second acoustic near-field propagation channel between a second loudspeaker and a right ear of the listener according to an implementation form.

The provider 101 comprises a processor 301 being configured to determine the first acoustic near-field transfer function $G_{LL}$ upon the basis of a location of the first loudspeaker and a location of the left ear of the listener, and to determine the second acoustic near-field transfer function $G_{RR}$ upon the basis of a location of the second loudspeaker and a location of the right ear of the listener.

The processor 301 can be configured to determine the first acoustic near-field transfer function $G_{LL}$ upon the basis of a first head related transfer function indicating the first acoustic near-field propagation channel in dependence of the location of the first loudspeaker and the location of the left ear of the listener, and to determine the second acoustic near-field transfer function $G_{RR}$ upon the basis of a second head related transfer function indicating the second acoustic near-field propagation channel in dependence of the location of the second loudspeaker and the location of the right ear of the listener.

Figure 4:
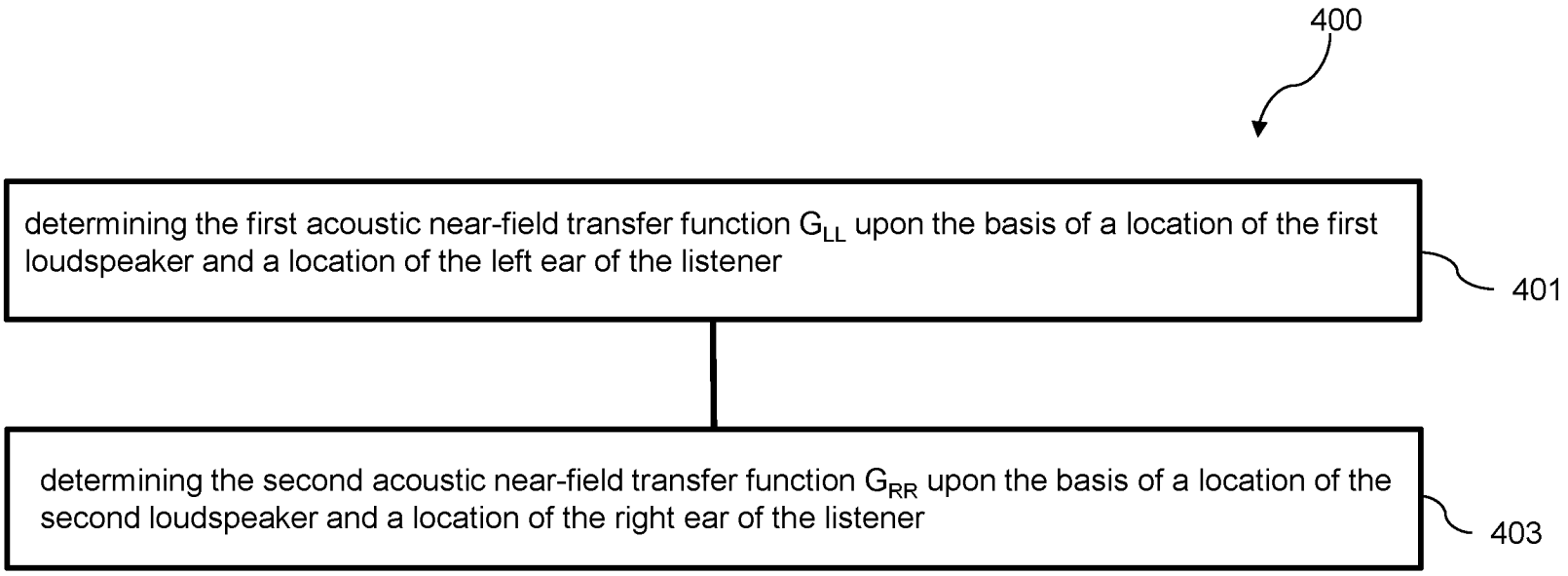
FIG. 4 shows a diagram of a method for providing a first acoustic near-field transfer function of a first acoustic near-field propagation channel between a first loudspeaker and a left ear of a listener and for providing a second acoustic near-field transfer function of a second acoustic near-field propagation channel between a second loudspeaker and a right ear of the listener according to an implementation form.

FIG. 4 shows a diagram of a method 400 for providing a first acoustic near-field transfer function $G_{LL}$ of a first acoustic near-field propagation channel between a first loudspeaker and a left ear of a listener and for providing a second acoustic near-field transfer function $G_{RR}$ of a second acoustic near-field propagation channel between a second loudspeaker and a right ear of the listener.

The method 400 comprises determining 401 the first acoustic near-field transfer function $G_{LL}$ upon the basis of a location of the first loudspeaker and a location of the left ear of the listener, and determining 403 the second acoustic near-field transfer function $G_{RR}$ upon the basis of a location of the second loudspeaker and a location of the right ear of the listener. The method 400 can be performed by the provider 101.

Figure 5:
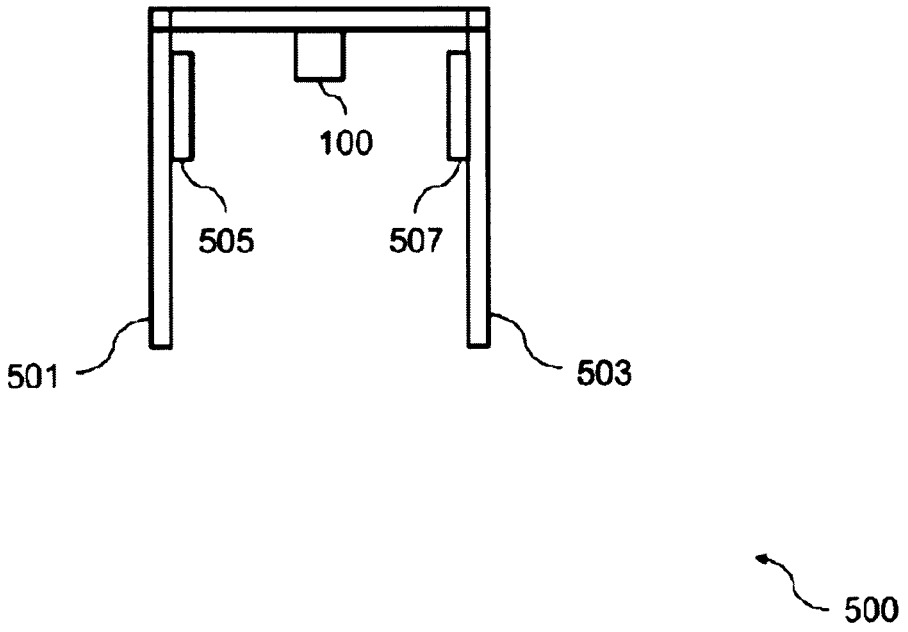
FIG. 5 shows a diagram of a wearable frame being wearable by a listener according to an implementation form.

FIG. 5 shows a diagram of a wearable frame 500 being wearable by a listener according to an implementation form.

The wearable frame 500 comprises an audio signal processing apparatus 100, the audio signal processing apparatus 100 being configured to pre-process a first input audio signal $E_L$ to obtain a first output audio signal $X_L$ and to pre-process a second input audio signal $E_R$ to obtain a second output audio signal $X_R$, a first leg 501 comprising a first loudspeaker 505, the first loudspeaker 505 being configured to emit the first output audio signal $X_L$ towards a left ear of the listener, and a second leg 503 comprising a second loudspeaker 507, the second loudspeaker 507 being configured to emit the second output audio signal $X_R$ towards a right ear of the listener.

The first leg 501 can comprise a first pair of loudspeakers, wherein the audio signal processing apparatus 100 can be configured to select the first loudspeaker 505 from the first pair of loudspeakers. The second leg 503 can comprise a second pair of loudspeakers, wherein the audio signal processing apparatus 100 can be configured to select the second loudspeaker 507 from the second pair of loudspeakers.

The disclosure relates to the field of audio rendering using loudspeakers situated near to ears of a listener, e.g. integrated in a wearable frame or three-dimensional (3D) glasses. The disclosure can be applied to render single- and multi-channel audio signals, i.e. mono signals, stereo signals, surround signals, e.g. 5.1, 7.1, 9.1, 11.1, or 22.2 surround signals, as well as binaural signals.

Audio rendering using loudspeakers situated near to the ears, i.e. at a distance between 1 and 15 centimeters (cm), has a growing interest with the development of wearable audio products, e.g. glasses, hats, or caps. Headphones, however, are usually situated directly on or even in the ears of the listener. Audio rendering should be capable of 3D audio rendering for extended audio experience for the listener.

Without further processing, the listener would perceive all audio signals rendered over such loudspeakers as being very close to the head, i.e. in the acoustic near-field. This can hold for single- and multi-channel audio signals, i.e. mono signals, stereo signals, surround signals, e.g. 5.1, 7.1, 9.1, 11.1, or 22.2 surround signals.

Binaural signals can be employed to convert a near-field audio perception into a far-field audio perception and to create a 3D spatial perception of spatial acoustic sources. Typically, these signals can be reproduced at the eardrums of the listener to correctly reproduce the binaural cues. Furthermore, a compensation taking the position of the loudspeakers into account can be employed which can allow for reproducing binaural signals using loudspeakers close to the ears.

A method for audio rendering over loudspeakers placed closely to the listener's ears can be applied, which can comprise a compensation of the acoustic near-field transfer functions between the loudspeakers and the ears, i.e. a first aspect, and a selection means configured to select for the rendering of an audio source the best pair of loudspeakers from a set of available pairs, i.e. a second aspect.

Audio rendering for wearable devices, such as 3D glasses, is typically achieved using headphones connected to the wearable device. The advantage of this approach is that it can provide a good audio quality. However, the headphones represent a second, somehow independent, device which the user needs to put into/onto his ears. This can reduce the comfort when putting-on and/or wearing the device. This disadvantage can be mitigated by integrating the audio rendering into the wearable device in such a way that it is not based on an additional action by the user when put on.

Bone conduction can be used for this purpose wherein bone conduction transducers mounted inside two sides of glasses, e.g. just behind the ears of the listener, can conduct the audio sound through the bones directly into the inner ears of the listener. However, as this approach does not produce sound waves in the ear canals, it may not be able to create a natural listening experience in terms of sound quality and/or spatial audio perception. In particular, high frequencies may not be conducted through the bones and may therefore be attenuated. Furthermore, the audio signal conducted at the left ear also travels to the right ear through the bones and vice versa. This crosstalk effect can interfere with binaural localization, e.g. left and/or right localization, of audio sources.

In general, these solutions to audio rendering for wearable devices can constitute a trade-off between comfort and audio quality. Bone conduction may be convenient to wear but can have a reduced audio quality. Using headphones can allow for obtaining a high audio quality but can have a reduced comfort.

The disclosure can overcome these limitations using loudspeakers for reproducing audio signals. The loudspeakers can be mounted onto the wearable device, e.g. a wearable frame. Therefore, high audio quality and wearing comfort can be achieved.

Loudspeakers close to the ears, as for example mounted on a wearable frame or 3D glasses, can have similar use cases as on-ear headphones or in-ear headphones but may often be preferred because they can be more comfortable to wear. When using loudspeakers which are placed at close distance to the ears, the listener can, however, perceive the presented signals as being very close, i.e. in the acoustic near-field.

In order to create a perception of a spatial or virtual sound source at a specific position far away, i.e. in the acoustic far-field, binaural signals can be used, either directly recorded using a dummy head or synthetic signals which can be obtained by filtering an audio source signal with a set of HRTFs. For presenting binaural signals to the user using loudspeakers in the far-field, a crosstalk cancellation problem may be solved and the acoustic transfer functions between the loudspeakers and the ears may be compensated.

The disclosure relates to using loudspeakers which are close to the head, i.e. in the acoustic near-field, and to creating a perception of audio sound sources at an arbitrary position in 3D space, i.e. in the acoustic far-field.

A way for audio rendering of a primary sound source S at a virtual spatial far-field position in 3D space is described, the far-field position e.g. being defined in a spherical coordinate system (r, θ, ϕ) using loudspeakers or secondary sound sources near the ears. The disclosure can improve the audio rendering for wearable devices in terms of wearing comfort, audio quality and/or 3D spatial audio experience.

The primary source, i.e. the input audio signal, can be any audio signal, e.g. an artificial mono source in augmented reality applications virtually placed at a spatial position in 3D space. For reproducing single- or multi-channel audio content, e.g. in mono, stereo, or 5.1 surround, the primary sources can correspond to virtual spatial loudspeakers virtually positioned in 3D space. Each virtual spatial loudspeaker can be used to reproduce one channel of the input audio signal.

The disclosure comprises a geometric compensation of an acoustic near-field transfer function between the loudspeakers and the ears to enable rendering of a virtual spatial audio source in the far-field, i.e. a first aspect, comprising the following steps: near-field compensation to enable a presentation of binaural signals using a robust crosstalk cancellation approach for loudspeakers close to the ears, a far-field rendering of the virtual spatial audio source using HRTFs to obtain the desired position, and optionally a correction of an inverse distance law.

The disclosure further comprises, as a function of a desired spatial sound source position, a determining of a driving function of the individual loudspeakers used in the reproduction, e.g. using a minimum of two pairs of loudspeakers, as a second aspect.

Figure 6:
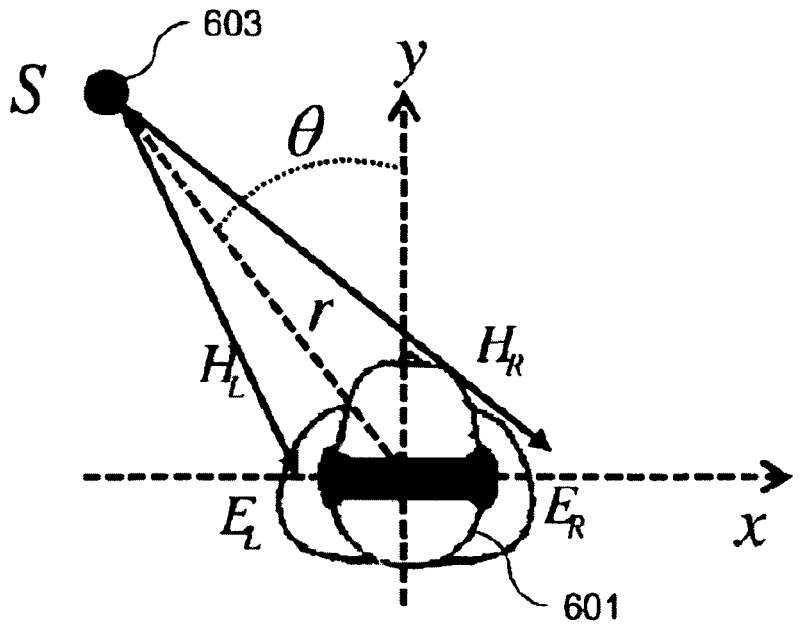
FIG. 6 shows a diagram of a spatial audio scenario comprising a listener and a spatial audio source according to an implementation form.

FIG. 6 shows a diagram of a spatial audio scenario comprising a listener 601 and a spatial audio source 603 according to an implementation form. The diagram relates to a virtual or spatial positioning of a primary spatial audio source S at a position (r,θ) using HRTFs in 2D with ϕ=0.

Binaural signals can be two-channel audio signals, e.g. a discrete stereo signal or a parametric stereo signal comprising a mono down-mix and spatial side information which can capture the entire set of spatial cues employed by the human auditory system for localizing audio sound sources.

The transfer function between an audio sound source with a specific position in space and a human ear is called HRTF. Such HRTFs can capture all localization cues such as inter-aural time differences (ITD) and/or inter-aural level differences (ILD). When reproducing such audio signals at the listeners' ear drums, e.g. using headphones, a convincing 3D audio perception with perceived positions of the acoustic audio sources spanning an entire 36' sphere around the listener can be achieved.

The binaural signals can be generated with HRTFs in frequency domain or with binaural room impulse responses (BRIRs) in time domain, or can be recorded using a suitable recording device such as a dummy head or in-ear microphones.

For example, referring to FIG. 6, an acoustic spatial audio source S, e.g. a person or a music instrument or even a mono loudspeaker, which generates an audio source signal S can be perceived by a user or listener, without headphones in contrast to FIG. 6, at the left ear as left ear entrance signal or left ear audio signal $E_L$ and at the right ear as right ear entrance signal or right ear audio signal $E_R$. The corresponding transfer functions for describing the transmission channel from the source S to the left ear $E_L$ and to the right ear $E_R$ can, for example, be the corresponding left and right ear HRTFs depicted as $H_L$ and $H_R$ in FIG. 6.

Analogously, as shown in FIG. 6, to create the perception of a virtual spatial audio source S positioned at a position $(r,\theta,\phi)$ in spherical coordinates to a listener placed at the origin of the coordinate system, the source signal S can be filtered with the HRTFs $H(r,\theta,\phi)$ corresponding to the virtual spatial audio source position and the left and right ear of the listener to obtain the ear entrance signals E, i.e. $E_L$ and $E_R$, which can be written also in complex frequency domain notation as $E_L(j\omega)$ and $E_R(j\omega)$:

$$\begin{pmatrix} E_L \\ E_R \end{pmatrix} = \begin{pmatrix} H_L \\ H_R \end{pmatrix} S. \tag{19}$$

In other words, by selecting an appropriate HRTF based on r, θ and φ for the desired virtual spatial position of an audio source S, any audio source signal S can be processed such that it is perceived by the listener as being positioned at the desired position, e.g. when reproduced via headphones or earphones.

An important aspect for the correct reproduction of the binaural localization cues produced in that way is that the ear signals E are reproduced at the eardrums of the listener which is naturally achieved when using headphones as depicted in FIG. 6 or earphones. Both, headphones and earphones, have in common that they are located directly on the ears or are located even in the ear and that the membranes of the loudspeaker comprised in the headphones or earphones are positioned such that they are directed directly towards the eardrum.

In many situations, however, wearing headphones is not appreciated by the listener as these may be uncomfortable to wear or they may block the ear from environmental sounds. Furthermore, many devices, e.g. mobiles, include loudspeakers. When considering wearable devices such as 3D glasses, a natural choice for audio rendering would be to integrate loudspeakers into these devices.

Using normal loudspeakers for reproducing binaural signals at the listener's ears can be based on solving a crosstalk problem, which may naturally not occur when the binaural signals are reproduced over headphones because the left ear signal $E_L$ can be directly and only reproduced at the left ear and the right ear signal $E_R$ can be directly and only reproduced at the right ear of the listener. One way of solving this problem may be to apply a crosstalk cancellation technique.

Figure 7:
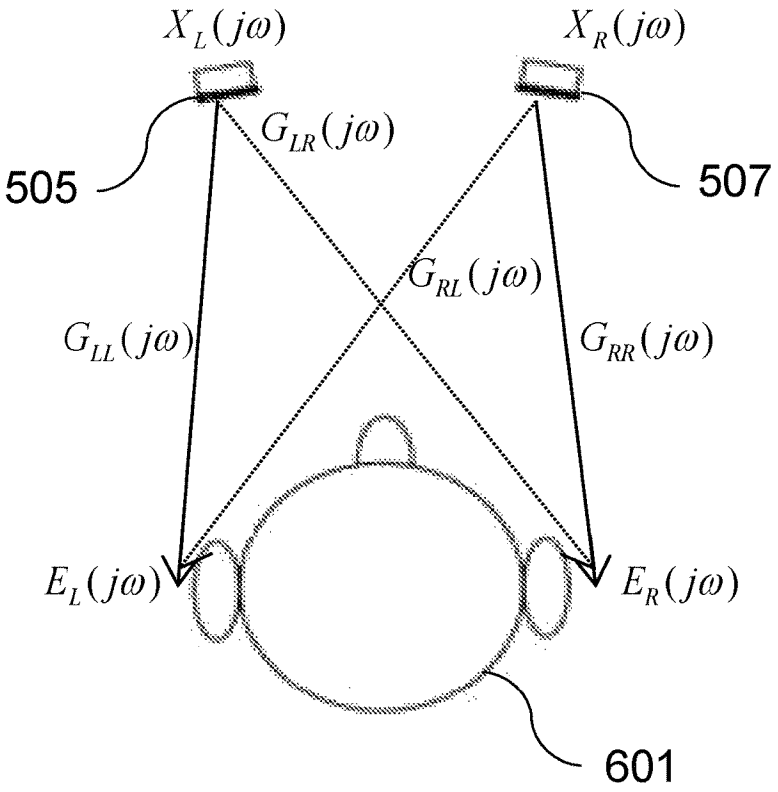
FIG. 7 shows a diagram of a spatial audio scenario comprising a listener, a first loudspeaker, and a second loudspeaker according to an implementation form.

FIG. 7 shows a diagram of a spatial audio scenario comprising a listener 601, a first loudspeaker 505, and a second loudspeaker 507 according to an implementation form. The diagram illustrates direct and crosstalk propagation paths.

By means of a crosstalk cancellation technique, for desired left and right ear entrance signals $E_L$ and $E_R$, corresponding loudspeaker signals can be computed. When a pair of remote left and right stereo loudspeakers plays back two signals, $X_L(j\omega)$ and $X_R(j\omega)$, a listener's left and right ear entrance signals, $E_L(j\omega)$ and $E_R(j\omega)$, can be modeled as:

$$\begin{pmatrix} E_L(j\omega) \\ E_R(j\omega) \end{pmatrix} = \begin{pmatrix} G_{LL}(j\omega) & G_{LR}(j\omega) \\ G_{RL}(j\omega) & G_{RR}(j\omega) \end{pmatrix} \begin{pmatrix} X_L(j\omega) \\ X_R(j\omega) \end{pmatrix}, \tag{20}$$

wherein $G_{LL}(j\omega)$ and $G_{RL}(j\omega)$ are the transfer functions from the left and right loudspeakers to the left ear, and $G_{LR}(j\omega)$ and $G_{RR}(j\omega)$ are the transfer functions from the left and right loudspeakers to the right ear. $G_{RL}(j\omega)$ and $G_{LR}(j\omega)$ can represent undesired crosstalk propagation paths which may be cancelled in order to correctly reproduce the desired ear entrance signals $E_L(j\omega)$ and $E_R(j\omega)$.

In vector matrix notation, (20) is:

$$E = GX, \tag{21}$$

With $$E = \begin{pmatrix} E_L(j\omega) \\ E_R(j\omega) \end{pmatrix}, G = \begin{pmatrix} G_{LL}(j\omega) & G_{LR}(j\omega) \\ G_{RL}(j\omega) & G_{RR}(j\omega) \end{pmatrix}, X = \begin{pmatrix} X_L(j\omega) \\ X_R(j\omega) \end{pmatrix}. \tag{22}$$

The loudspeaker signals X corresponding to given desired ear entrance signals E are:

$$X = G^{-1}E, \tag{23}$$

Figure 8:
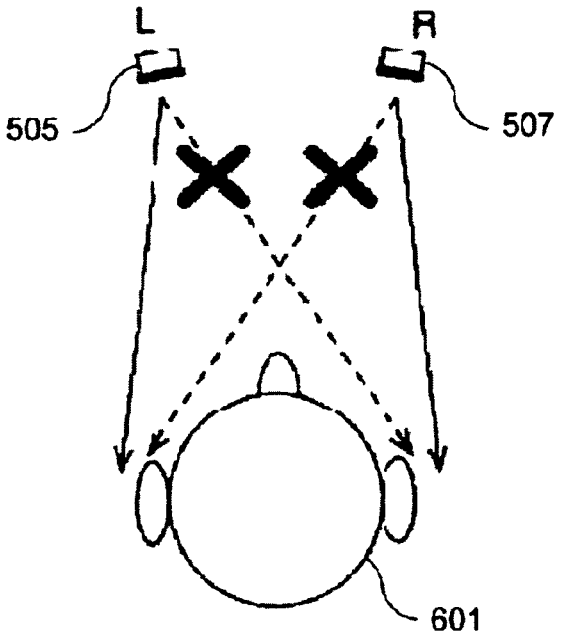
FIG. 8 shows a diagram of a spatial audio scenario comprising a listener, a first loudspeaker, and a second loudspeaker according to an implementation form.

FIG. 8 shows a diagram of a spatial audio scenario comprising a listener 601, a first loudspeaker 505, and a second loudspeaker 507 according to an implementation form. The diagram relates to a visual explanation of a crosstalk cancellation technique.

In order to provide 3D sound with crosstalk cancellation, the ear entrance signals E can be computed with HRTFs at whatever desired azimuth and elevation angles. The goal of crosstalk cancellation can be to provide a similar experience as a binaural presentation over headphones, but by means of two loudspeakers. FIG. 8 visually explains the cross-talk cancellation technique.

However, this technique can remain difficult to implement since it can invoke an inversion of matrices which may often be ill-conditioned. Matrix inversion may result in impractically high filter gains, which may not be used in practice. A large dynamic range of the loudspeakers may be desirable and a high amount of acoustic energy may be radiated to areas other than the two ears. Furthermore, playing binaural signals to a listener using a pair of loudspeakers, not necessarily in stereo, may create an acoustic front and/or back confusion effect, i.e. audio sources which may in fact be located in the front may be localized by the listener as being in his back and vice versa.

Figure 9:
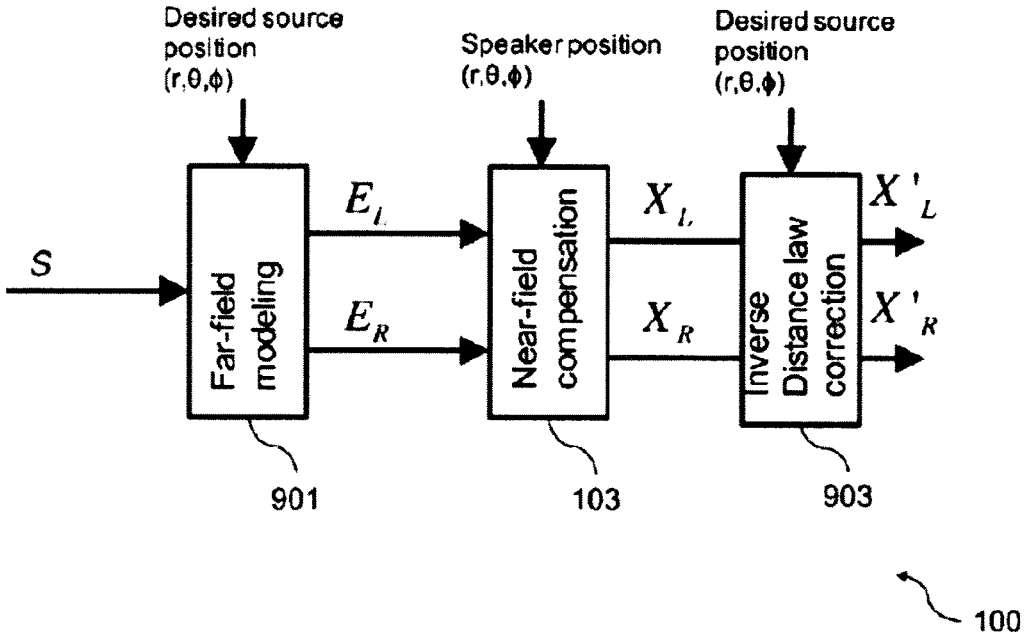
FIG. 9 shows a diagram of an audio signal processing apparatus for pre-processing a first input audio signal to obtain a first output audio signal and for pre-processing a second input audio signal to obtain a second output audio signal according to an implementation form.

FIG. 9 shows a diagram of an audio signal processing apparatus 100 for pre-processing a first input audio signal $E_L$ to obtain a first output audio signal $X_L$ and for pre-processing a second input audio signal $E_R$ to obtain a second output audio signal $X_R$ according to an implementation form. The audio signal processing apparatus 100 comprises a filter 103, a further filter 901, and a weighter 903. The diagram provides an overview comprising a far-field modelling step, a near-field compensation step and an optional inverse distance law correction step.

The further filter 901 is configured to perform a far-field modeling upon the basis of a desired audio source position (r,θ,ϕ). The further filter 901 processes a source audio signal S to provide the first input audio signal $E_L$ and the second input audio signal $E_R$.

The filter 103 is configured to perform a near-field compensation upon the basis of loudspeaker positions (r,θ,ϕ). The filter 103 processes the first input audio signal $E_L$ and the second input audio signal $E_R$ to provide the first output audio signal $X_L$ and the second output audio signal $X_R$.

The weighter 903 is configured to perform an inverse distance law correction upon the basis of a desired audio source position (r,θ,ϕ). The weighter 903 processes the first output audio signal $X_L$ and the second output audio signal $X_R$ to provide a first weighted output audio signal $X'_L$ and a second weighted output audio signal $X'_R$.

In order to create a desired far-field perception of a virtual spatial audio source emitting a source audio signal S, a far-field modeling based on HRTFs can be applied to obtain the desired ear signals E, e.g. binaurally. In order to reproduce the ear signals E using the loudspeakers, a near-field compensation can be applied to obtain the loudspeaker signals X and optionally, an inverse distance law can be corrected to obtain the loudspeaker signals X'. The desired position of the primary spatial audio source S can be flexible, wherein the loudspeaker position can depend on a specific setup of the wearable device.

The near-field compensation can be performed as follows. The conventional crosstalk cancellation can suffer from ill-conditioning problems caused by a matrix inversion. As a result, presenting binaural signals using loudspeakers can be challenging.

Considering the crosstalk cancellation problem with one pair of loudspeakers, i.e. stereo comprising left and right, located near the ears, the problem can be simplified. The finding is that the crosstalk between the loudspeakers and the ear entrance signals can be much smaller than for a signal emitted from a far-field position. It can become so small that it can be assumed that the transfer functions from the left and right loudspeakers to the right and left ears, i.e. to the opposite ears, can better be neglected:

$$G_{LR}(j\omega)=G_{RL}(j\omega)=0. \tag{24}$$

This finding can lead to an easier solution. The two-by-two matrix in equation (22) can e.g. be diagonal. The solution can be equivalent to two simple inverse problems:

$$X_L(j\omega)=\frac{E_L(j\omega)}{G_{LL}(j\omega)} \text{ and } X_R(j\omega)=\frac{E_R(j\omega)}{G_{RR}(j\omega)} \tag{25}$$

In particular, this simplified formulation of the crosstalk cancellation problem can avoid typical problems of conventional crosstalk cancellation approaches, can lead to a more robust implementation which may not suffer from ill-conditioning problems and at the same time can achieve very good performance. This can make the approach particularly suited for presenting binaural signals using loudspeakers close to the ears.

This approach includes HRTFs to derive the loudspeaker signals $X_L$ and $X_R$. The goal can be to apply a filter network to match the near-field loudspeakers to a desired virtual spatial audio source. The transfer functions $G_{LL}(j\omega)$ and $G_{RR}(j\omega)$ can be computed as inverse near-field transfer functions, i.e. (inverse NFTFs), to undo the near-field effects of the loudspeakers.

Based on an HRTF spherical model Γ(σ,μ,θ,ϕ) according to:

$$\Gamma(\rho,\mu,\theta,\phi)=-\frac{\rho}{\mu}e^{-j\mu\rho}\sum_{m=0}^{\infty}(2m+1)P_m\cos\theta\frac{h_m(\mu\rho)}{h'_m(\mu)}, \tag{26}$$

the NFTFs can be derived for the left NFTF, with index L, and the right NFTF, with index R. Below, a left NFTF is exemplarily given as:

$$\Gamma^L_{NF}(\rho,\mu,\theta,\phi)=\frac{\Gamma^L(\rho,\mu,\theta,\phi)}{\Gamma^L(\infty,\mu,\theta,\phi)}, \tag{27}$$

wherein ϱ is the normalized distance to the loudspeaker according to:

$$\rho=\frac{r}{a}, \tag{28}$$

with r being a range of the loudspeaker and a being a radius of a sphere which can be used to approximate the size of a human head. Experiments show that a can e.g. be in the range of 0.05 m≤a ≤0.12 m. μ is defined as a normalized frequency according to:

$$\mu=\frac{2af}{c}, \tag{29}$$

with f being a frequency and c being the celerity of sound. Θ is an angle of incidence, e.g. the angle between the ray from the center of the sphere to the loudspeaker and the ray to the measurement point on the surface of the sphere. Eventually, φ is an elevation angle. The functions $P_m$ and $h_m$ represent a Legendre polynomial of degree m and an $m^{th}$-order spherical Hankel function, respectively. $h'_m$ is the first derivative of $h_m$. A specific algorithm can be applied to get recursively an estimate of Γ.

An NFTF can be used to model the transfer function between the loudspeakers and the ears.

$$G_{LL}(j\omega)=\Gamma_{NF}{}^L(\rho,\mu,\theta,\phi) \tag{30}$$

The corresponding applies for the right NFTF using an index R in equations (27) to (30) instead of an index L.

By inverting the NFTFs (27) from the loudspeakers to the ears, the effect of the close distances between the loudspeakers and the ears in Eqn. (26) can be cancelled, which can yield near-field compensated loudspeaker driving signals X for the desired ear signals E according to:

$$X_L(j\omega)=\frac{E_L(j\omega)}{G_{LL}(j\omega)} \text{ and } X_R(j\omega)=\frac{E_R(j\omega)}{G_{RR}(j\omega)} \tag{31}$$

The HRTF based far-field rendering can be performed as follows. In order to create a far-field impression of a virtual spatial audio source S, binaural signals corresponding to the desired left and right ear entrance signals $E_L$ and $E_R$ can be obtained by filtering the audio source signal S with a set of HRTFs corresponding to the desired far-field position according to:

$$\begin{pmatrix} E_L \\ E_R \end{pmatrix} = \begin{pmatrix} H_L \\ H_R \end{pmatrix} S \tag{32}$$

This filtering can e.g. be implemented as convolution in time- or multiplication in frequency-domain.

The inverse distance law can be applied as follows. Additionally and optionally to the far-field binaural effects rendered by the modified HRTFs, the range of the spatial audio source can further be considered using an inverse distance law. The sound pressure at a given distance from the spatial audio source can be assumed to be proportional to the inverse of the distance.

Considering the distance of the spatial audio source to the center of the head, which can be modeled by a sphere of radius a, a gain proportional to the inverse distance can be derived:

$$g(\rho) = \left(\frac{r_0}{r}\right)^{\alpha} = \left(\frac{r_0}{a\rho}\right)^{\alpha}, \tag{33}$$

wherein $r_0$ is the radius of an imaginary sphere on which the gain applied can be normalized to 0 decibels (dB). This can, e.g., be the distance of the loudspeakers to the ears.

$\alpha$ is an exponent parameter making the inverse distance law more flexible, e.g. with $\alpha$=0.5 a doubling of the distance r can result in a gain reduction of 3 dB, with $\alpha$=1 a doubling of the distance r can result in a gain reduction of 6 dB, and with $\alpha$=2 a doubling of the distance r can result in a gain reduction of 12 dB.

The gain (33) can equally be applied to both the left and right loudspeaker signals:

$$x' = g(\rho) \cdot x. \tag{34}$$

Figure 10:
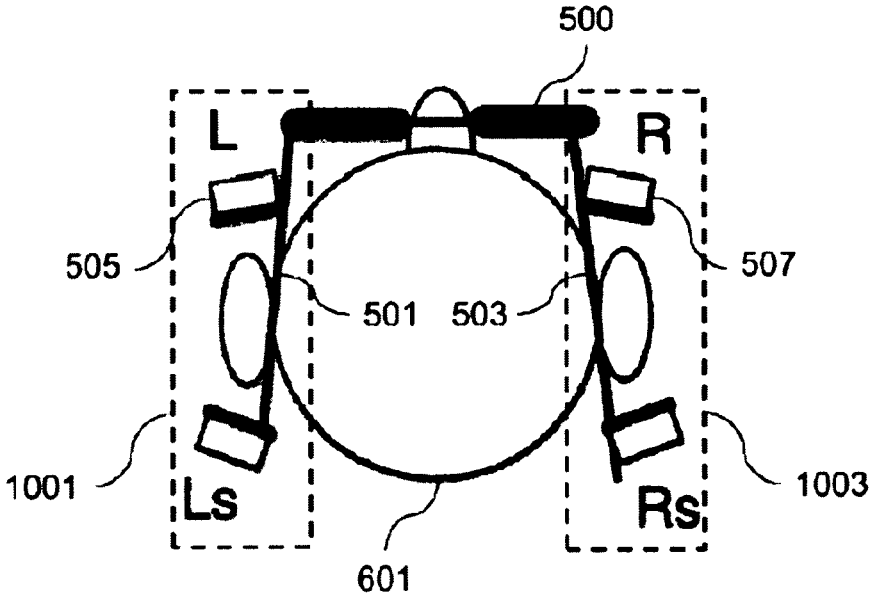
FIG. 10 shows a diagram of a wearable frame being wearable by a listener according to an implementation form.

FIG. 10 shows a diagram of a wearable frame 500 being wearable by a listener 601 according to an implementation form. The wearable frame 500 comprises a first leg 501 and a second leg 503. The first loudspeaker 505 can be selected from the first pair of loudspeakers 1001. The second loudspeaker 507 can be selected from the second pair of loudspeakers 1003. The diagram can relate to 3D glasses featuring four small loudspeakers.

Figure 11:
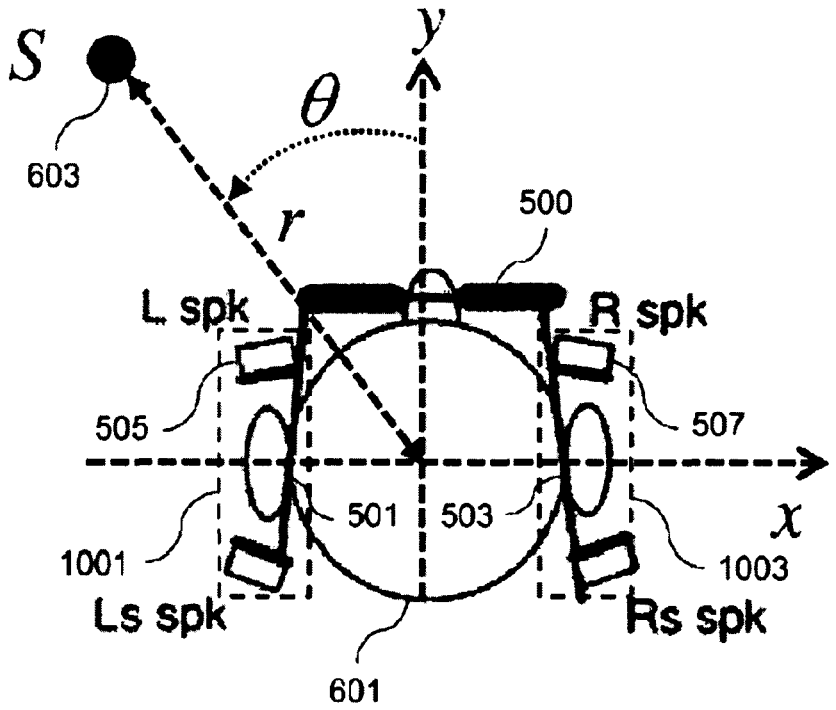
FIG. 11 shows a diagram of a wearable frame being wearable by a listener according to an implementation form.

FIG. 11 shows a diagram of a wearable frame 500 being wearable by a listener 601 according to an implementation form. The wearable frame 500 comprises a first leg 501 and a second leg 503. The first loudspeaker 505 can be selected from the first pair of loudspeakers 1001. The second loudspeaker 507 can be selected from the second pair of loudspeakers 1003. A spatial audio source 603 is arranged relative to the listener 601. The diagram depicts a loudspeaker selection based on a virtual spatial source angle $\theta$.

A loudspeaker pair selection can be performed as follows. The approach can be extended to a multi loudspeaker or a multi loudspeaker pair use case as depicted in FIG. 10. Considering two pairs of loudspeakers around the head, based on an azimuth angle $\Theta$ of the spatial audio source S to reproduced, a simple decision can be taken to use either the front or the back loudspeaker pair as illustrated in FIG. 11. If $-90<\theta<90$, the front loudspeaker $x_L$ and $x_R$ pair can be active. If $90<\theta<270$, the rear loudspeaker $x_{Ls}$ and $x_{Rs}$ pair can be active.

This can resolve the problem of a front-back confusion effect where spatial audio sources in the back of the listener are erroneously localized in the front, and vice versa. The chosen pair can then be processed using the far-field modeling and near-field compensation as described previously. This model can be refined using a smoother transition function between front and back instead of the described binary decision.

Furthermore, alternative examples are possible with e.g. a pair of loudspeakers below the ears and a pair of loudspeakers above the ears. In this case, the problem of elevation confusion can be solved, wherein a spatial audio source below the listener may be located as above, and vice versa. In this case, the loudspeaker selection can be based on an elevation angle $\varphi$.

In a general case, given a number of pairs of loudspeakers arranged at different positions $(\theta,\phi)$, the pair which has the minimum angular difference to the audio source can be used for rendering a primary spatial audio source.

The disclosure can be advantageously applied to create a far-field impression in various implementation forms.

Figure 12:
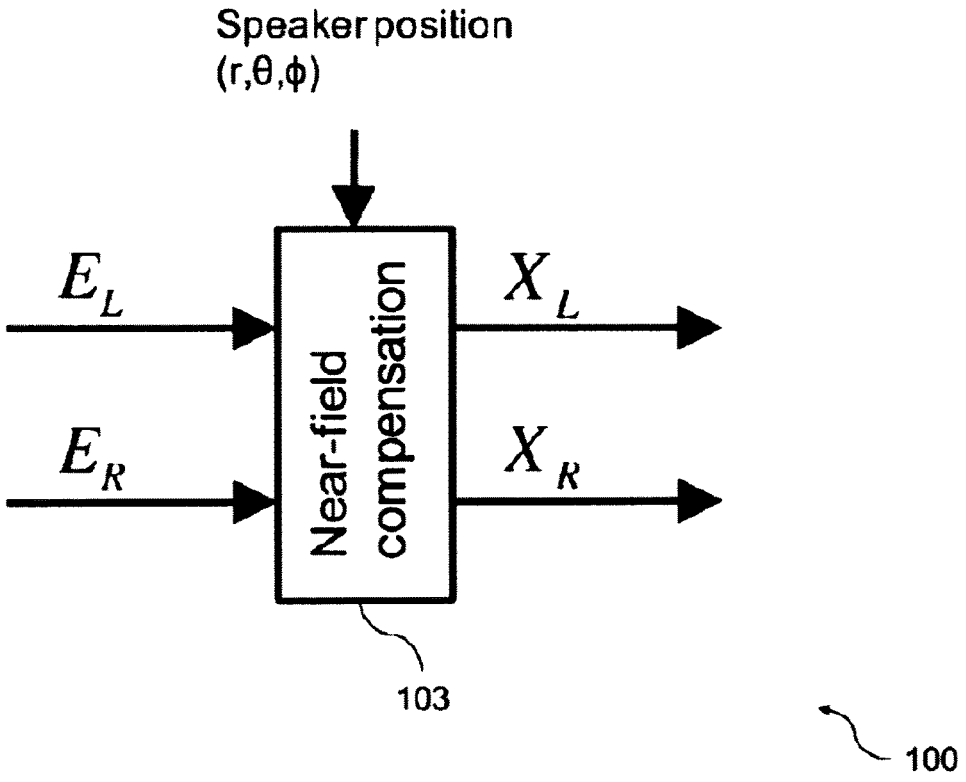
FIG. 12 shows a diagram of an audio signal processing apparatus for pre-processing a first input audio signal to obtain a first output audio signal and for pre-processing a second input audio signal to obtain a second output audio signal according to an implementation form.

FIG. 12 shows a diagram of an audio signal processing apparatus 100 for pre-processing a first input audio signal $E_L$ to obtain a first output audio signal $X_L$ and for pre-processing a second input audio signal $E_R$ to obtain a second output audio signal $X_R$ according to an implementation form. The audio signal processing apparatus 100 comprises a filter 103. The filter 103 is configured to perform a near-field compensation upon the basis of loudspeaker positions $(r,\theta,\phi)$. The diagram relates to a playback of a binaural signal $E=(E_L, E_R)^T$, wherein no far-field modelling may be applied.

As explained previously, based on equations (27) to (30), by inverting NFTFs from equation (27) from the loudspeakers to the ears, the effect of the close distances between loudspeakers and ears in Eqn. (26) can be cancelled, which can yield a near-field compensation for the loudspeaker driving signals X based on the desired or given binaural ear signals E according to:

$$X_L(j\omega) = \frac{E_L(j\omega)}{G_{LL}(j\omega)} \text{ and } X_R(j\omega) = \frac{E_R(j\omega)}{G_{RR}(j\omega)} \tag{35}$$

In typical implementation forms, the loudspeakers can be arranged at fixed positions and orientations on the wearable device and, thus, can also have predetermined positions and orientations with regard to the listener's ears. Therefore, the NFTF and the corresponding inverse NFTF for the left and right loudspeaker positions can be determined in advance.

Figure 13:
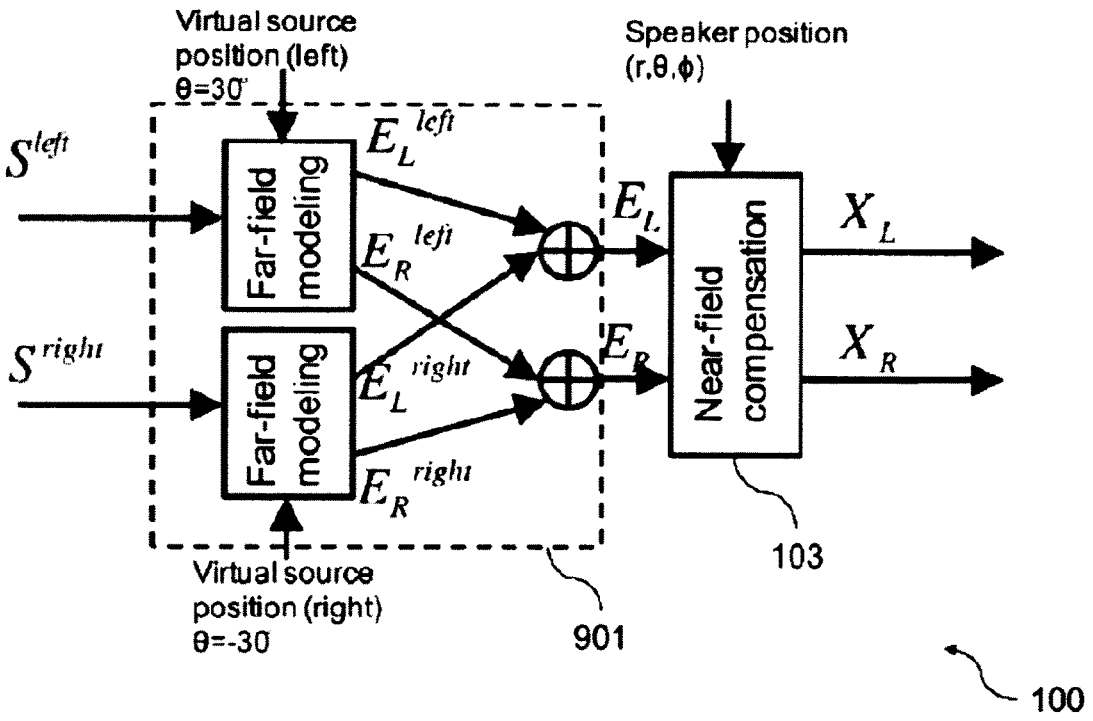
FIG. 13 shows a diagram of an audio signal processing apparatus for pre-processing a first input audio signal to obtain a first output audio signal and for pre-processing a second input audio signal to obtain a second output audio signal according to an implementation form.

FIG. 13 shows a diagram of an audio signal processing apparatus 100 for pre-processing a first input audio signal $E_L$ to obtain a first output audio signal $X_L$ and for pre-processing a second input audio signal $E_R$ to obtain a second output audio signal $X_R$ according to an implementation form.

The diagram relates to an example for rendering a conventional stereo signal with two channels $S=(S^{left},S^{right})^T$. Each audio channel of the stereo signal can be rendered as a primary audio source, e.g. as a virtual loudspeaker, at $\theta=\pm 30°$ with $\theta$ as defined, to mimic a typical loudspeaker setup used for stereo playback.

The audio signal processing apparatus 100 comprises a filter 103. The filter 103 is configured to perform a near-field compensation upon the basis of loudspeaker positions $(r,\theta,\phi)$.

The audio signal processing apparatus 100 further comprises a further filter 901. The further filter 901 is configured to perform a far-field modeling upon the basis of a virtual spatial audio source position, e.g. at the left at $\theta=30°$. A source audio signal $S^{left}$ is processed to provide an auxiliary input audio signal $E_L^{left}$ and an auxiliary input audio signal $E_R^{left}$. The further filter 901 is further configured to perform a far-field modeling upon the basis of a further virtual spatial audio source position, e.g. at the right at θ=−30°. A source audio signal $S^{right}$ is processed to provide an auxiliary input audio signal $E_L^{right}$ and an auxiliary input audio signal $E_R^{right}$. The further filter 901 is further configured to determine the first input audio signal $E_L$ by adding the auxiliary input audio signal $E_L^{left}$ and the auxiliary input audio signal $E_L^{right}$, and to determine the second input audio signal $E_R$ by adding the auxiliary input audio signal $E_R^{left}$ and the auxiliary input audio signal $E_R^{right}$.

The audio signal processing apparatus 100 can be employed for stereo and/or surround sound reproduction. The audio signal processing apparatus 100 can be applied to enhance the spatial reproduction of two channel stereo signals $S=(S^{left},S^{right})^T$ by creating two primary spatial audio sources e.g. at θ=±30° with θ as defined, which can act as virtual loudspeakers in the far-field.

To achieve this, the general processing can be applied to the left channel $S^{left}$ and to the right channel $S^{right}$ of the stereo signal S independently. Firstly, far-field modelling can be applied to obtain a binaural signal $E^{left}=(E_L^{left},E_R^{left})^T$ creating the perception that $S^{left}$ is emitted by a virtual loudspeaker at the position θ=30°. Analogously, $E^{right}=(E_L^{right},E_R^{right})^T$ can be obtained from $S^{left}$ using a virtual loudspeaker position θ=−30°. Then, the binaural signal E can be obtained by summing $E^{left}$ and $E^{right}$:

$$E=\begin{pmatrix}E_L\\E_R\end{pmatrix}=\begin{pmatrix}E_L^{left}\\E_R^{left}\end{pmatrix}+\begin{pmatrix}E_L^{right}\\E_R^{right}\end{pmatrix} \tag{36}$$

Subsequently, the resulting binaural signal E can be converted into the loudspeaker signal X in the near-field compensation step. Optionally, the inverse distance law correction can be applied analogously.

Figure 14:
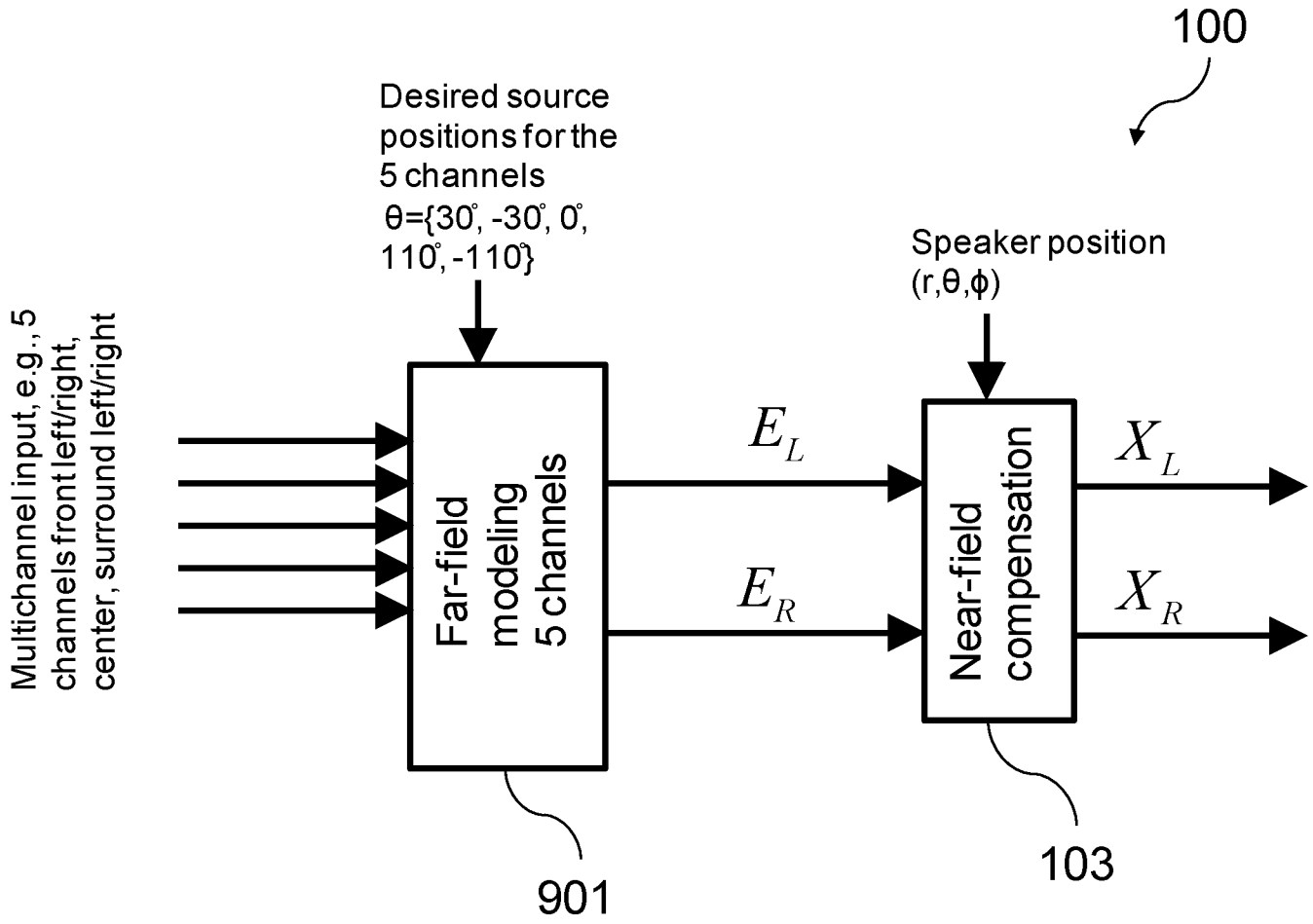
FIG. 14 shows a diagram of an audio signal processing apparatus for pre-processing a first input audio signal to obtain a first output audio signal and for pre-processing a second input audio signal to obtain a second output audio signal according to an implementation form.

FIG. 14 shows a diagram of an audio signal processing apparatus 100 for pre-processing a first input audio signal $E_L$ to obtain a first output audio signal $X_L$ and for pre-processing a second input audio signal $E_R$ to obtain a second output audio signal $X_R$ according to an implementation form.

In the same way as for stereo signals, multichannel signals, e.g. a 5.1 surround signal, can be rendered by creating for each channel as virtual loudspeaker placed at the respective position, e.g. front left/right θ=±30°, center θ=0°, surround left/right θ=±110°. The resulting binaural signals can be summed up and a near-field correction can be performed to obtain the loudspeaker driving signals $X_L$,$X_R$.

The audio signal processing apparatus 100 comprises a filter 103. The filter 103 is configured to perform a near-field compensation upon the basis of loudspeaker positions (r,θ,ϕ).

The audio signal processing apparatus 100 further comprises a further filter 901. The further filter 901 is configured to perform a far-field modelling, e.g. for 5 channels. The further filter 901 processes a multi-channel input, e.g. 5 channels at front left/right, center, surround left/right, upon the basis of desired spatial audio source positions, e.g. for the 5 channels at θ={30°, −30°, 0°, 110°, −110°} to provide the first input audio signal $E_L$ and the second input audio signal $E_R$.

The disclosure can also be applied to enhance the spatial reproduction of multi-channel surround signals by creating one primary spatial audio source for each channel of the input signal.

The figure shows a 5.1 surround signal as an example which can be seen as a multi-channel extension of the stereo use case explained previously. In this case, the virtual spatial positions of the primary spatial audio source, i.e. the virtual loudspeakers, can correspond to θ={30°, −30°, 0°, 110°, −110°}. The general processing as introduced can be applied to each channel of the input audio signal independently. Firstly, a far-field modelling can be applied to obtain a binaural signal for each channel of the input audio signal. All binaural signals can be summed up yielding $E=(E_L,E_R)^T$ as explained for the stereo case previously.

Subsequently, the resulting binaural signal E can be converted into the loudspeaker signal X in the near-field compensation step. Optionally, the inverse distance law correction can be applied analogously.

Figure 15:
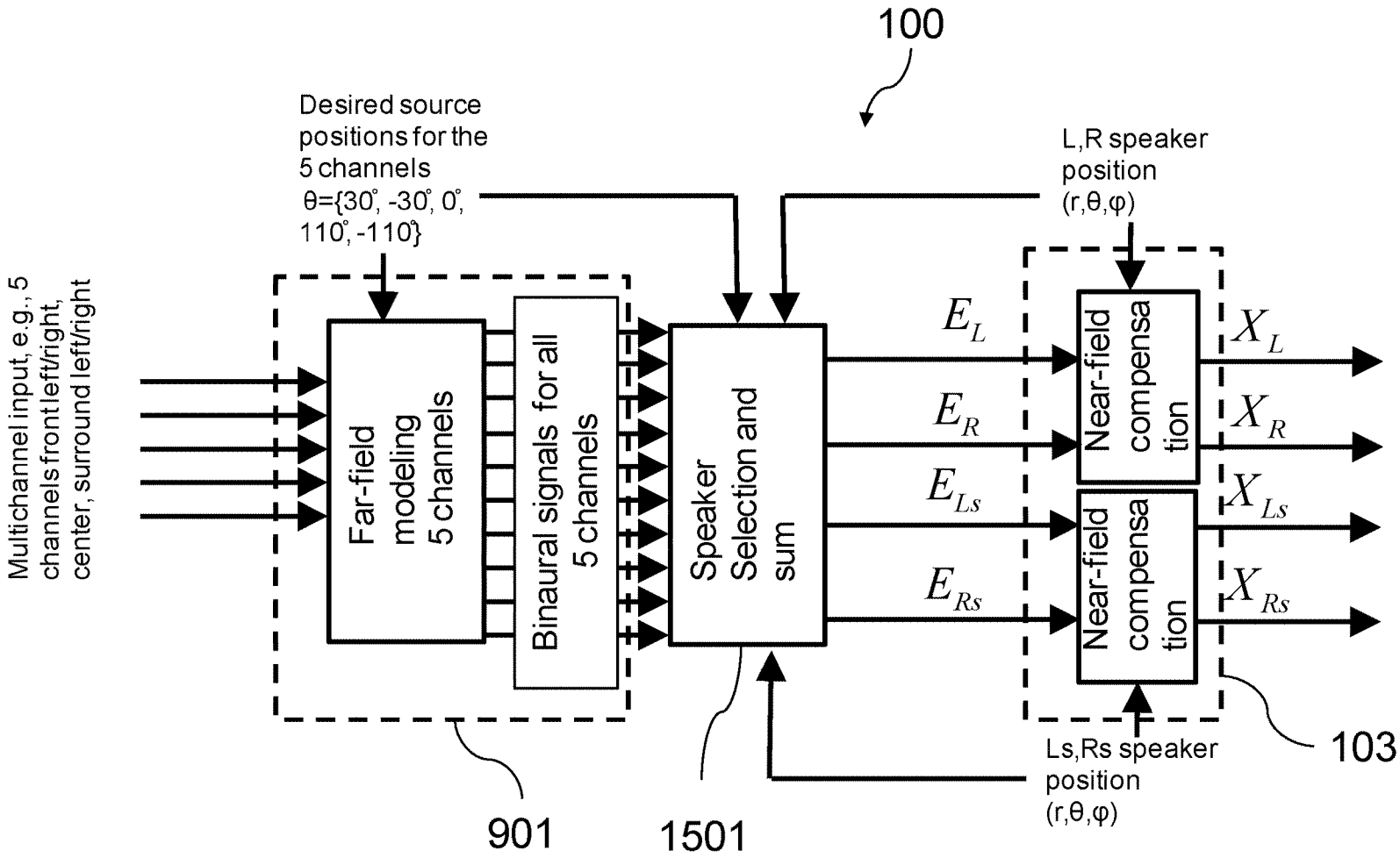
FIG. 15 shows a diagram of an audio signal processing apparatus for pre-processing a plurality of input audio signals to obtain a plurality of output audio signals according to an implementation form.

FIG. 15 shows a diagram of an audio signal processing apparatus 100 for pre-processing a plurality of input audio signals $E_L$, $E_R$, $E_{Ls}$, $E_{Rs}$ to obtain a plurality of output audio signals $X_L$, $X_R$, $X_{Ls}$, $X_{Rs}$ according to an implementation form. The diagram relates to a multi-channel signal reproduction using two loudspeaker pairs with one pair in the front, i.e. L and R, and one in the back, i.e. Ls and Rs, of the listener.

The audio signal processing apparatus 100 comprises a filter 103. The filter 103 is configured to perform a near-field compensation upon the basis of the L and R loudspeaker positions (r,θ,ϕ). The filter 103 processes the input audio signals $E_L$ and $E_R$ to provide the output audio signals $X_L$ and $X_R$. The filter 103 is further configured to perform a near-field compensation upon the basis of the Ls and Rs loudspeaker positions (r,θ,ϕ). The filter 103 processes the input audio signals $E_{Ls}$ and $E_{Rs}$ to provide the output audio signals $X_{Ls}$ and $X_{Rs}$.

The audio signal processing apparatus 100 further comprises a further filter 901. The further filter 901 is configured to perform a far-field modelling, e.g. for 5 channels. The further filter 901 processes a multi-channel input, e.g. 5 channels at front left/right, center, surround left/right, upon the basis of desired spatial audio source positions, e.g. for the 5 channels at θ={30°, −30°, 0°, 110°, −110°}. The further filter 901 is configured to provide binaural signals for all 5 channels.

The audio signal processing apparatus 100 further comprises a selector 1501 being configured to perform a loudspeaker selection and summation upon the basis of the L and R loudspeaker positions (r,θ,ϕ), the Ls and Rs loudspeaker positions (r,θ,ϕ), and/or the desired spatial audio source positions, e.g. for the 5 channels at θ={30°, −30°, 0°, 110°, −110°}.

The audio signal processing apparatus 100 can be applied for surround sound reproduction using multiple pairs of loudspeakers located close to the ears.

It can be advantageously applied to a multi-channel surround signal by considering each channel as a single primary spatial audio source with a fixed and/or pre-defined far-field position. For instance, a 5.1 sound track could be reproduced over a wearable frame or 3D glasses defining the position of each channel as a single audio sound source situated, in a spherical coordinate system, at the following positions: the L channel with r=2 m, θ=30°, φ=0°, the R channel with r=2 m, θ=−30°, φ=0°, the C channel with r=2 m, θ=0°, φ=0°, the Ls channel with r=2 m, θ=110°, φ=0°, and/or the Rs channel with r=2 m, 0=−110°, φ=0°.

The figure depicts the processing. All channels can be processed by the far-field modeling with the respective audio source angle in order to obtain binaural signals for all channels. Then, based on the loudspeaker angle, for each signal the best pair of loudspeakers, e.g. front or back, can be selected as explained previously.

Summing up all binaural signals to be reproduced by the front loudspeaker pair L, R can form the binaural signal $E_L$, $E_R$ which can then be near-field compensated to form the loudspeaker driving signals $X_L$,$X_R$. Summing up all binaural signals to be reproduced by the back loudspeaker pair Ls, Rs can form the binaural signal $E_{LS}$,$E_{Rs}$ which can then be near-field compensated to obtain the loudspeaker driving signals $X_{Ls}$,$X_{Rs}$.

Because the virtual spatial front and back far-field loudspeakers can be reproduced by near-field loudspeakers which can also be placed in the front and back of the listeners' ears, the front-back confusion effect can be avoided. This processing can be extended to arbitrary multichannel formats, not just 5.1 surround signals.

The disclosure can provide the following advantages. Loudspeakers close to the head can be used to create a perception of a virtual spatial audio source far away. Near-field transfer functions between the loudspeakers and the ears can be compensated using a simplified and more robust formulation of a crosstalk cancellation problem. HRTFs can be used to create the perception of a far-field audio source. A near-field head shadowing effect can be converted into a far-field head shadowing effect. Optionally, a 1/r effect, i.e. distance, can also be corrected.

The disclosure introduces using multiple pairs of loudspeakers near the ears as a function of the audio sound source position, and deciding which loudspeakers are active for playback. It can be extended to an arbitrary number of loudspeaker pairs. The approach can, e.g., be applied for 5.1 surround sound tracks. The spatial perception or impression can be three-dimensional. With regard to binaural playback using conventional headphones, advantages in terms of solid externalization and reduced front/back confusion can be achieved.

The disclosure can be applied for 3D sound rendering applications and can provide a 3D sound using wearable devices and wearable audio products, such as 3D glasses, or hats.

The disclosure relates to a method for audio rendering over loudspeakers placed closely, e.g. 1 to 10 cm, to the listener's ears. It can comprise a compensation of near-field-transfer functions, and/or a selection of a best pair of loudspeakers from a set of pairs of loudspeakers. The disclosure relates to a signal processing feature.

Figure 16:
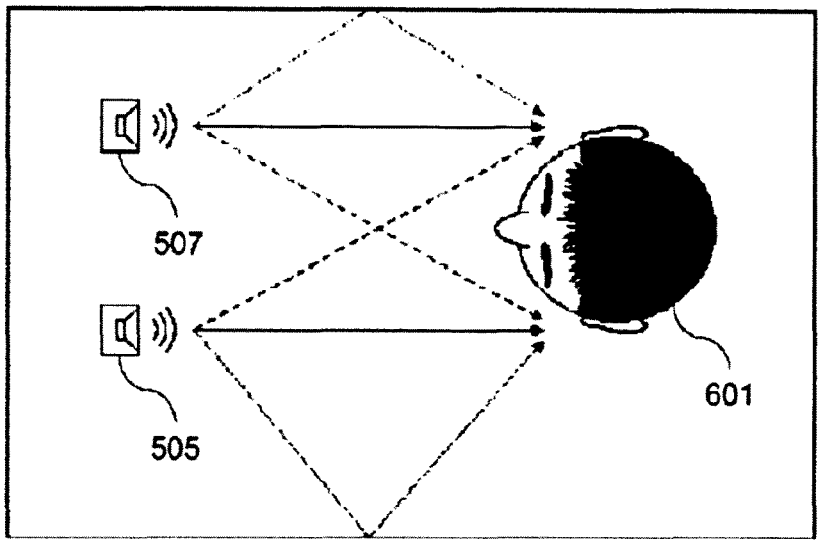
FIG. 16 shows a diagram of a spatial audio scenario comprising a listener, a first loudspeaker, and a second loudspeaker according to an implementation form.

FIG. 16 shows a diagram of a spatial audio scenario comprising a listener 601, a first loudspeaker 505, and a second loudspeaker 507 according to an implementation form.

Utilizing loudspeakers for the reproduction of audio signals can induce the problem of crosstalk, i.e. each loudspeaker signal arrives at both ears. Moreover, additional propagation paths can be introduced due to reflections at walls or ceiling and other objects in the room, i.e. reverberation.

Figure 17:
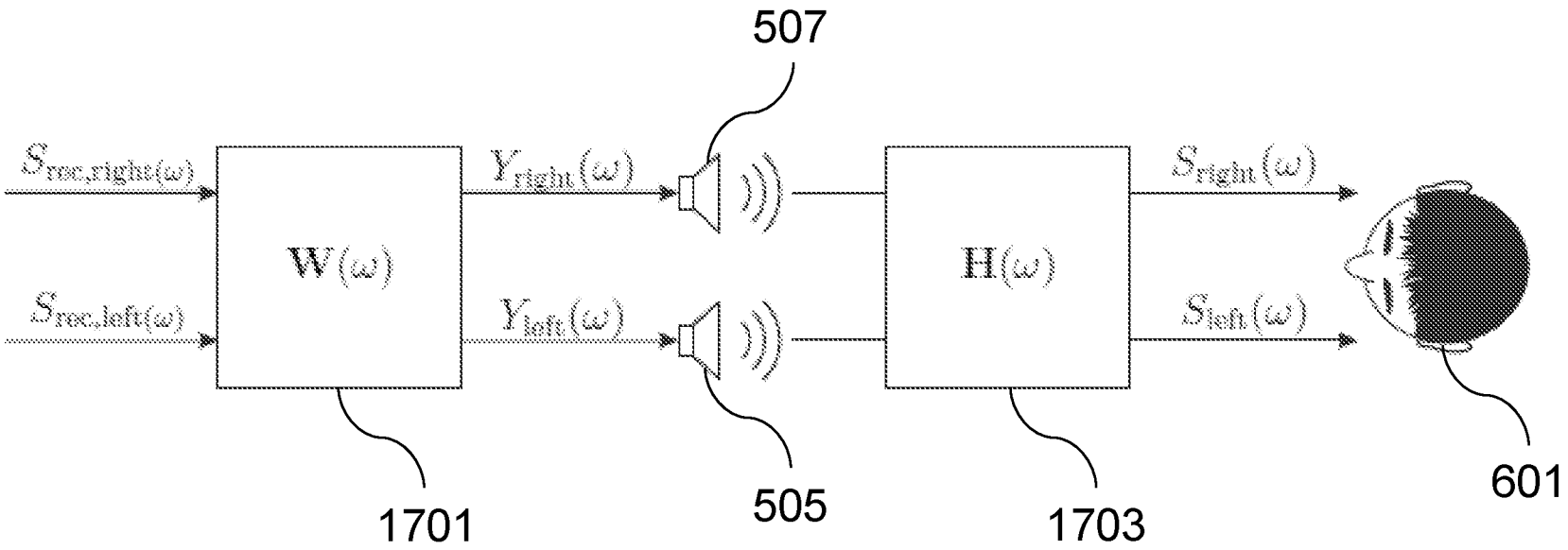
FIG. 17 shows a diagram of a spatial audio scenario comprising a listener, a first loudspeaker, and a second loudspeaker according to an implementation form.

FIG. 17 shows a diagram of a spatial audio scenario comprising a listener 601, a first loudspeaker 505, and a second loudspeaker 507 according to an implementation form. The diagram further comprises a first transfer function block 1701 and a second transfer function block 1703. The diagram illustrates a general crosstalk cancellation technique using inverse filtering.

The first transfer function block 1701 processes the audio signals $S_{rec,right}(\omega)$ and $S_{rec,left}(\omega)$ to provide the audio signals $Y_{right}(\omega)$ and $Y_{left}(\omega)$ using a transfer function $W(\omega)$. The second transfer function block 1703 processes the audio signals $Y_{right}(\omega)$ and $Y_{left}(\omega)$ to provide the audio signals $S_{right}(\omega)$ and $S_{left}(\omega)$ using a transfer function $H(\omega)$.

An approach for removing the undesired acoustic crosstalk can be an inverse filtering or a crosstalk cancellation. In order to reproduce the binaural signals at the listeners ears and to cancel the acoustic crosstalk, such that $s_{rec}(w) \equiv s(w)$, it is desirable that:

$$W(\omega)=H^{-1}(\omega) \tag{37}$$

For loudspeakers which are far away from the listener, e.g. several meters, crosstalk cancellation can be challenging. Plant matrices can often be ill-conditioned, and matrix inversion can result in impractically high filter gains, which may not be used in practice. A very large dynamic range of the loudspeakers can be desirable and a high amount of acoustic energy may be radiated to areas other than the two ears.

When presenting binaural signals to a listener, front/back confusion can appear, i.e. audio sources which are in the front may be localized in the back of the listener and vice versa.

Figure 18:
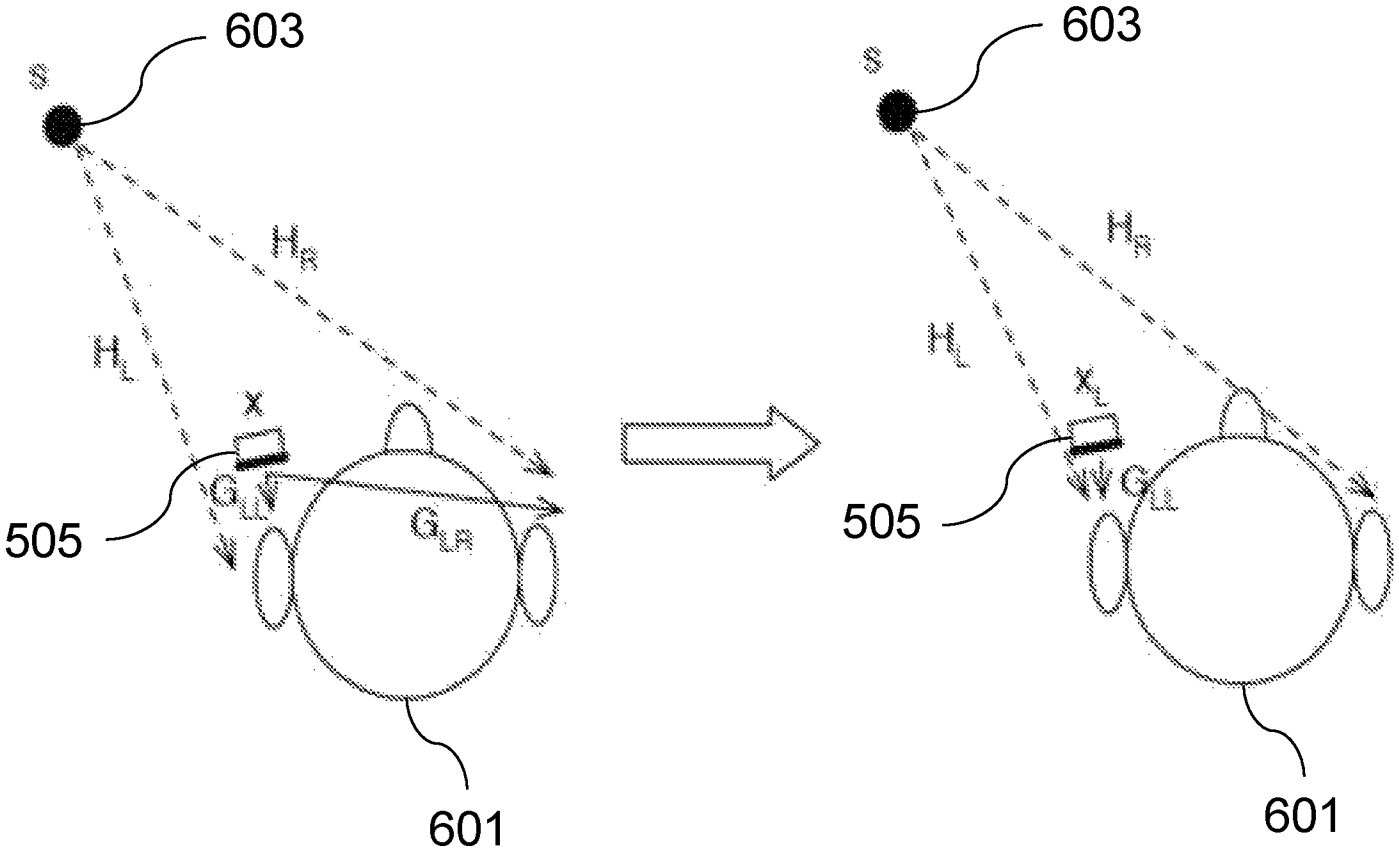
FIG. 18 shows a diagram of a spatial audio scenario comprising a listener, a first loudspeaker, and a spatial audio source according to an implementation form.

FIG. 18 shows a diagram of a spatial audio scenario comprising a listener 601, a first loudspeaker 505, and a spatial audio source 603 according to an implementation form. The first loudspeaker 505 is indicated by x and $x_L$. The spatial audio source 603 is indicated by s.

A first acoustic near-field transfer function $G_{LL}$ indicates a first acoustic near-field propagation channel between the first loudspeaker 505 and the left ear of the listener 601. A first acoustic crosstalk transfer function $G_{LR}$ indicates a first acoustic crosstalk propagation channel between the first loudspeaker 505 and the right ear of the listener 601.

A first acoustic far-field transfer function $H_L$ indicates a first acoustic far-field propagation channel between the spatial audio source 603 and the left ear of the listener 601. A second acoustic far-field transfer function $H_R$ indicates a second acoustic far-field propagation channel between the spatial audio source 603 and the right ear of the listener 601.

An audio rendering of a virtual spatial sound source s(t) at a virtual spatial position, e.g. r, θ, φ, using loudspeakers or secondary audio sources near the ears can be applied.

The approach can be based on a geometric compensation of the near-field transfer functions between the loudspeakers and the ears to enable rendering of a virtual spatial audio source in the far-field. The approach can further be based on, as a function of the desired audio sound source position, a determining of a driving function of individual loudspeakers used in the reproduction, e.g. using a minimum of two pairs of loudspeakers. The approach can remove the crosstalk by moving the loudspeakers close to the ears of the listener.

For a loudspeaker x close to the listener, the crosstalk between the ear entrance signals can be much smaller than for a signal s emitted from a far-field position. It can become so small that it can be assumed that:

$$G_{LR}(j\omega)=G_{RL}(j\omega)=0 \tag{38}$$

i.e. no crosstalk may occur. This can increase the robustness of the approach and can simplify the crosstalk cancellation problem.

Figure 19:
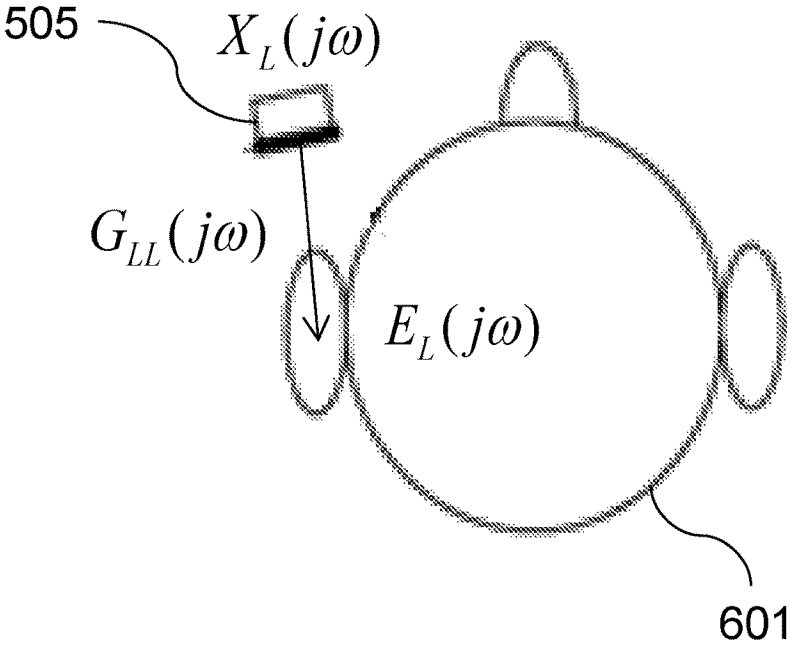
FIG. 19 shows a diagram of a spatial audio scenario comprising a listener, and a first loudspeaker according to an implementation form.

FIG. 19 shows a diagram of a spatial audio scenario comprising a listener 601, and a first loudspeaker 505 according to an implementation form.

The first loudspeaker 505 emits an audio signal $X_L(j\omega)$ over a first acoustic near-field propagation channel between the first loudspeaker 505 and the left ear of the listener 601 to obtain a desired ear entrance audio signal $E_L(j\omega)$ at the left ear of the listener 601. The first acoustic near-field propagation channel is indicated by a first acoustic near-field transfer function $G_{LL}$.

Loudspeakers close to the ears can have similar use cases as headphones or earphones but may be preferred because they may be more comfortable to wear. Similarly as headphones, loudspeakers close to the ears may not exhibit crosstalk. However, virtual spatial audio sources rendered using the loudspeakers may appear close to the head of the listener.

Binaural signals can be used to create a convincing perception of acoustic spatial audio sources far away. In order to provide a binaural signal $E_L(j\omega)$ to the ears using loudspeakers close to the ears, the transfer function $G_{LL}(j\omega)$ between the loudspeakers and the ears may be compensated according to:

$$X_L(j\omega) = \frac{E_L(j\omega)}{G_{LL}(j\omega)} \text{ and } X_R(j\omega) = \frac{E_R(j\omega)}{G_{RR}(j\omega)} \tag{39}$$

In order to compensate the transfer functions, NFTFs can be derived based on an HRTF spherical model $\Gamma(\rho,\mu,\theta)$ according to:

$$\Gamma^L_{NF}(\rho, \mu, \theta, \phi) = \frac{\Gamma^L(\rho, \mu, \theta, \phi)}{\Gamma^L(\infty, \mu, \theta, \phi)} \tag{40}$$

Figure 20:
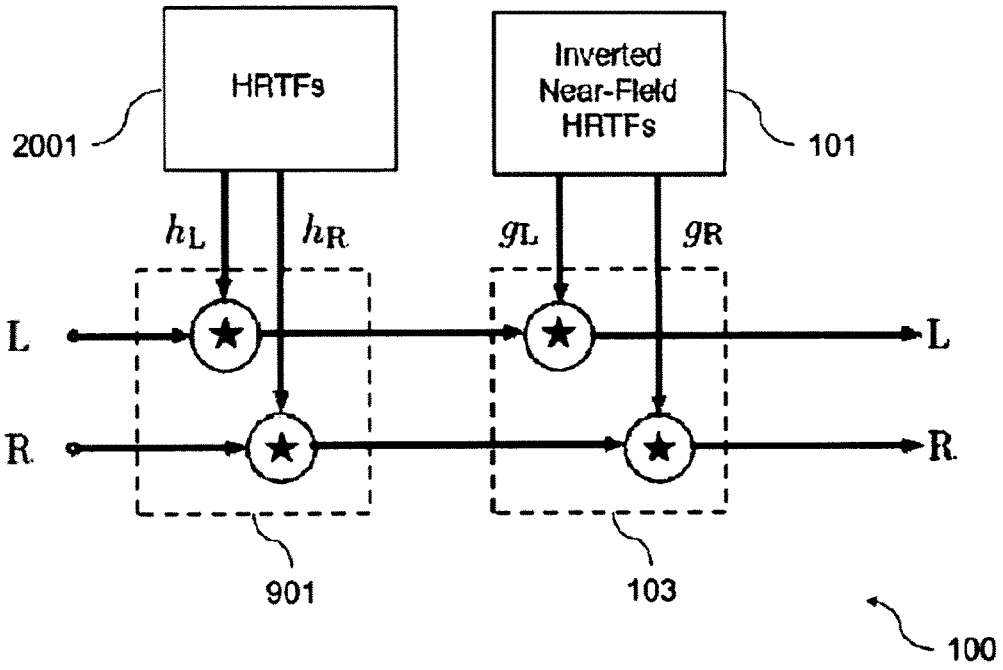
FIG. 20 shows a diagram of an audio signal processing apparatus for pre-processing a first input audio signal to obtain a first output audio signal and for pre-processing a second input audio signal to obtain a second output audio signal according to an implementation form.

FIG. 20 shows a diagram of an audio signal processing apparatus 100 for pre-processing a first input audio signal to obtain a first output audio signal and for pre-processing a second input audio signal to obtain a second output audio signal according to an implementation form. The audio signal processing apparatus 100 comprises a provider 101, a further provider 2001, a filter 103, and a further filter 901.

The provider 101 is configured to provide inverted near-filed HRTFs $g_L$ and $g_R$. The further provider 2001 is configured to provide HRTFs $h_L$ and $h_R$. The further filter 901 is configured to convolute a left channel audio signal L by $h_L$, and to convolute a right channel audio signal R by $h_R$. The filter 103 is configured to convolute the convoluted left channel audio signal by $g_L$, and to convolute the convoluted right channel audio signal by $g_R$.

After the compensation, the left and right ear entrance signals $e_L$ and $e_R$ can be filtered using HRTFs at a desired far-field azimuth and/or elevation angle. The implementation can be done in time domain with a two stage convolution for each loudspeaker channel. Firstly, a convolution with the corresponding HRTFs, i.e. $h_L$ and $h_R$, can be performed. Secondly, a convolution with the inverted NFTFs, i.e. $g_L$ and $g_R$, can be performed.

The distance of the spatial audio source can further be corrected using an inverse distance law according to:

$$g(\rho) = \left(\frac{r_0}{r}\right)^\alpha = \left(\frac{r_0}{a\rho}\right)^\alpha \tag{40}$$

wherein $r_0$ can be a radius of an imaginary sphere on which the gain applied can be normalized to 0 dB. $\alpha$ is an exponent parameter making the inverse distance law more flexible. For $\alpha$=0.5, a doubling of the distance r can result in a gain reduction of 3 dB. For $\alpha$=1, a doubling of the distance r can result in a gain reduction of 6 dB. For $\alpha$=2, a doubling of the distance r can result in a gain reduction of 12 dB. $g(\rho)$ can be multiplied to the binaural signal.

Loudspeakers close to the head of a listener can be used to create a perception of a virtual spatial audio source far away. Near-field transfer functions between the loudspeakers and the ears can be compensated and HRTFs can be used to create the perception of a far-field spatial audio source. A near-field head shadowing effect can be converted into a far-field head shadowing effect. A 1/r effect, due to a distance, can also be corrected.

Figure 21:
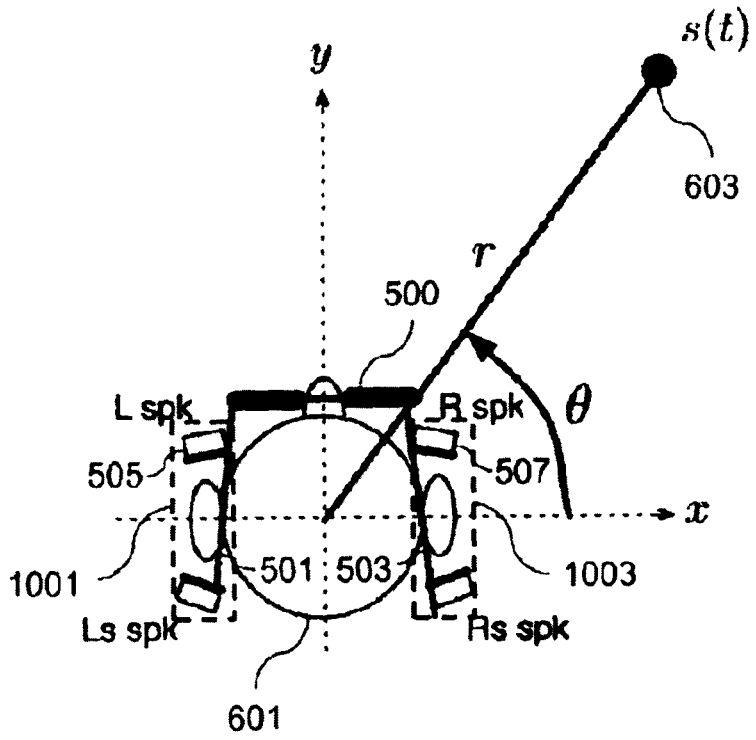
FIG. 21 shows a diagram of a wearable frame being wearable by a listener according to an implementation form.

FIG. 21 shows a diagram of a wearable frame 500 being wearable by a listener 601 according to an implementation form. The wearable frame 500 comprises a first leg 501 and a second leg 503. The first loudspeaker 505 can be selected from the first pair of loudspeakers 1001. The second loudspeaker 507 can be selected from the second pair of loudspeakers 1003. A spatial audio source 603 is arranged relative to the listener 601. The diagram depicts a loudspeaker selection based on a virtual spatial source angle $\theta$. FIG. 21 corresponds to FIG. 11, wherein a different definition of the angle $\theta$ is used.

When presenting binaural signals to a listener, a front/back confusion effect can appear, i.e. spatial audio sources which are in the front may be localized in the back and vice versa. The disclosure introduces using multiple pairs of loudspeakers near the ears, as a function of the spatial audio sound source position, and deciding which loudspeakers are active for playback. For example, two pairs of loudspeakers located in the front and in the back of the ears can be used.

As a function of the azimuth angle $\theta$, a selection of front or back loudspeakers, which best match a desired sound rendering direction $\theta$, can be performed. If $180>\theta>0$, the front loudspeaker xL and xR pair can be active. If $-180<\theta<0$, the front loudspeaker xLs and xRs pair can be active. If $\theta$=0 or 180, both front and back pairs can be used.

The disclosure can provide the following advantages. By means of a loudspeaker selection as a function of a spatial audio source direction, cues related to the listener's ears can be generated, making the approach more robust with regard to front/back confusion. The approach can further be extended to an arbitrary number of loudspeaker pairs.

What is claimed is:

1. An audio signal processing apparatus comprising:

a provider configured to:

provide a first acoustic near-field transfer function of a first acoustic near-field propagation channel between a first loudspeaker and a left ear of a listener; and provide a second acoustic near-field transfer function of a second acoustic near-field propagation channel between a second loudspeaker and a right ear of the listener; and a filter coupled to the provider and configured to:

filter a first input audio signal based on a first inverse of the first acoustic near-field transfer function to obtain a first output audio signal that is independent of a second input audio signal; and filter the second input audio signal based on a second inverse of the second acoustic near-field transfer function to obtain a second output audio signal that is independent of the first input audio signal; and filter the first input audio signal and the second input audio signal according to the following equations:

$$X_L(j\omega) = \frac{E_L(j\omega)}{G_{LL}(j\omega)} \text{ and } X_R(j\omega) = \frac{E_R(j\omega)}{G_{RR}(j\omega)},$$

wherein $E_L$ denotes the first input audio signal, and $E_R$ denotes the second input audio signal, $X_L$ denotes the first output audio signal, $X_R$ denotes the second output audio signal, $G_{LL}$ denotes the first acoustic near-field transfer function, $G_{RR}$ denotes the second acoustic near-field transfer function, ω denotes an angular frequency, and j denotes an imaginary unit.

2. The audio signal processing apparatus of claim 1, further comprising a memory for providing the first acoustic near-field transfer function and the second acoustic near-field transfer function, wherein the provider is further configured to retrieve the first acoustic near-field transfer function and the second acoustic near-field transfer function from the memory to provide the first acoustic near-field transfer function and the second acoustic near-field transfer function.

3. The audio signal processing apparatus of claim 1, wherein the provider is further configured to:

determine the first acoustic near-field transfer function based on a first location of the first loudspeaker and a second location of the left ear; and determine the second acoustic near-field transfer function based on a third location of the second loudspeaker and a fourth location of the right ear.

4. The audio signal processing apparatus of claim 1, further comprising a second filter configured to:

filter a source audio signal based on a first acoustic far-field transfer function to obtain the first input audio signal; and filter the source audio signal based on a second acoustic far-field transfer function to obtain the second input audio signal.

5. The audio signal processing apparatus of claim 4, wherein the source audio signal is associated with a spatial audio source within a spatial audio scenario, wherein the second filter is further configured to:

determine the first acoustic far-field transfer function based on a first location of the spatial audio source within the spatial audio scenario and a second location of the left ear; and determine the second acoustic far-field transfer function based on the first location and a third location of the right ear.

6. The audio signal processing apparatus of claim 5, further comprising a weighter configured to:

determine a weighting factor based on a distance between the spatial audio source and the listener; and weight the first output audio signal and the second output audio signal by the weighting factor.

7. The audio signal processing apparatus of claim 6, wherein the weighter is further configured to further determine the weighting factor according to the following equation:

$$g(\rho) = \left(\frac{r_0}{r}\right)^{\alpha} = \left(\frac{r_0}{a\rho}\right)^{\alpha},$$

wherein g denotes the weighting factor, ρ denotes a normalized distance, r denotes a range, $r_0$ denotes a reference range, a denotes a radius, and α denotes an exponent parameter.

8. The audio signal processing apparatus of claim 5, further comprising a selector configured to:

determine an azimuth angle or an elevation angle of the spatial audio source with regard to a fourth location of the listener; and select the first loudspeaker from a first pair of loudspeakers (1001) and select the second loudspeaker from a second pair of loudspeakers based on the azimuth angle, the elevation angle, or both the azimuth angle and the elevation angle.

9. An audio signal processing method comprising:

providing a first acoustic near-field transfer function of a first acoustic near-field propagation channel between a first loudspeaker and a left ear of a listener;

providing a second acoustic near-field transfer function of a second acoustic near-field propagation channel between a second loudspeaker and a right ear of the listener;

filtering a first input audio signal based on a first inverse of the first acoustic near-field transfer function to obtain a first output audio signal that is independent of a second input audio signal; and filtering the second input audio signal based on a second inverse of the second acoustic near-field transfer function to obtain a second output audio signal ($X_R$) that is independent of the first input audio signal, wherein filtering the first input audio signal and filtering the second input audio signal comprises filtering the first input audio signal and the second input audio signal according to the following equations:

$$X_L(j\omega) = \frac{E_L(j\omega)}{G_{LL}(j\omega)} \text{ and } X_R(j\omega) = \frac{E_R(j\omega)}{G_{RR}(j\omega)},$$

wherein $E_L$ denotes the first input audio signal, and $E_R$ denotes the second input audio signal, $X_L$ denotes the first output audio signal, $X_R$ denotes the second output audio signal, $G_{LL}$ denotes the first acoustic near-field transfer function, $G_{RR}$ denotes the second acoustic near-field transfer function,ω denotes an angular frequency, and j denotes an imaginary unit.

10. A provider comprising:

a processor configured to:

determine a first acoustic near-field transfer function of a first acoustic near-field propagation channel between a first loudspeaker and a left ear of a listener based on a first location of the first loudspeaker and a second location of the left ear;

determine a second acoustic near-field transfer function of a second acoustic near-field propagation channel between a second loudspeaker and a right ear of the listener based on a third location of the second loudspeaker and a fourth location of the right ear;

determine the first acoustic near-field transfer function based on a first head-related transfer function indicating a dependence of the first acoustic near-field propagation channel on the first location and the second location;

determine the second acoustic near-field transfer function based on a second head-related transfer function indicating a dependence of the second acoustic near-field propagation channel on the third location and the fourth location; and determine the first acoustic near-field transfer function and the second acoustic near-field transfer function according to the following equations:

$$G_{LL}(j\omega) = \Gamma^L_{NF}(\rho, \mu, \theta, \phi) \text{ with } \Gamma^L_{NF}(\rho, \mu, \theta, \phi) = \frac{\Gamma^L(\rho, \mu, \theta, \phi)}{\Gamma^L(\infty, \mu, \theta, \phi)},$$

$$G_{RR}(j\omega) = \Gamma^R_{NF}(\rho, \mu, \theta, \phi) \text{ with } \Gamma^L_{NF}(\rho, \mu, \theta, \phi) = \frac{\Gamma^R(\rho, \mu, \theta, \phi)}{\Gamma^R(\infty, \mu, \theta, \phi)}$$

-continued $$\Gamma(\rho, \mu, \theta, \phi) = -\frac{\rho}{\mu} e^{-j\mu\rho} \sum_{m=0}^{\infty} (2m+1) P_m \cos\theta \frac{h_m(\mu\rho)}{h_m(\mu)},$$

$$\rho = \frac{r}{a}, \mu = \frac{2af}{c},$$

$$\mu = \frac{2af}{c},$$

wherein $G_{LL}$ denotes the first acoustic near-field transfer function, and $G_{RR}$ denotes the second acoustic near-field transfer function, $\Gamma^L$ denotes the first head related transfer function, $\Gamma^R$ denotes the second head related transfer function, ω denotes an angular frequency, j denotes an imaginary unit, $P_m$ denotes a Legendre polynomial of degree m, $h_m$ denotes an $m^{th}$ order spherical Hankel function, $h'_m$ denotes a first derivative of $h_m$, ρ denotes a normalized distance, r denotes a range, a denotes a radius, μ denotes a normalized frequency, f denotes a frequency, c denotes a celerity of sound, θ denotes an azimuth angle, and ϕ denotes an elevation angle.

11. A method comprising:

determining a first acoustic near-field transfer function of a first acoustic near-field propagation channel between a first loudspeaker and a left ear of a listener based on a first location of the first loudspeaker and a second location of the left ear of the listener;

determining a second acoustic near-field transfer function of a second acoustic near-field propagation channel between a second loudspeaker and a right ear of the listener based on a third location of the second loudspeaker and a fourth location of the right ear;

determining a first acoustic near-field transfer function and the second acoustic near-field transfer function according to the following equations:

$$G_{LL}(j\omega) = \Gamma^L_{NF}(\rho, \mu, \theta, \phi) \text{ with } \Gamma^L_{NF}(\rho, \mu, \theta, \phi) = \frac{\Gamma^L(\rho, \mu, \theta, \phi)}{\Gamma^L(\infty, \mu, \theta, \phi)},$$

$$G_{RR}(j\omega) = \Gamma^R_{NF}(\rho, \mu, \theta, \phi) \text{ with } \Gamma^L_{NF}(\rho, \mu, \theta, \phi) = \frac{\Gamma^R(\rho, \mu, \theta, \phi)}{\Gamma^R(\infty, \mu, \theta, \phi)}$$

$$\Gamma(\rho, \mu, \theta, \phi) = -\frac{\rho}{\mu} e^{-j\mu\rho} \sum_{m=0}^{\infty} (2m+1) P_m \cos\theta \frac{h_m(\mu\rho)}{h_m(\mu)},$$

$$\rho = \frac{r}{a}, \mu = \frac{2af}{c},$$

$$\mu = \frac{2af}{c},$$

wherein $G_{LL}$ denotes the first acoustic near-field transfer function, $G_{RR}$ denotes the second acoustic near-field transfer function, $\Gamma^L$ denotes the first head related transfer function, $\Gamma^R$ denotes the second head related transfer function, ω denotes an angular frequency, j denotes an imaginary unit, $P_m$ denotes a Legendre polynomial of degree m, $h_m$ denotes an $m^{th}$ order spherical Hankel function, $h'_m$ denotes a first derivative of $h_m$, ρ denotes a normalized distance, r denotes a range, a denotes a radius, μ denotes a normalized frequency, f denotes a frequency, c denotes a celerity of sound, θ denotes an azimuth angle, and ϕ denotes an elevation angle.

12. A wearable frame comprising:

an audio signal processing apparatus configured to:

pre-process a first input audio signal to obtain a first output audio signal; and pre-process a second input audio signal to obtain a second output audio signal;

a first leg comprising a first loudspeaker configured to emit the first output audio signal towards a left ear of a listener; and a second leg comprising a second loudspeaker configured to emit the second output audio signal towards a right ear of the listener, wherein the first leg further comprises a first pair of loudspeakers, wherein the second leg further comprises a second pair of loudspeakers, and wherein the audio signal processing apparatus is further configured to:

select the first loudspeaker from the first pair, and select the second loudspeaker from the second pair.

13. The wearable frame of claim 12, wherein the audio signal processing apparatus comprises a provider configured to:

provide a first acoustic near-field transfer function of a first acoustic near-field propagation channel between the first loudspeaker and the left ear; and provide a second acoustic near-field transfer function of a second acoustic near-field propagation channel between the second loudspeaker and the right ear.

14. An apparatus comprising:

a memory; and a processor coupled to the memory and configured to:

provide a first acoustic near-field transfer function of a first acoustic near-field propagation channel between a first loudspeaker and a left ear of a listener;

provide a second acoustic near-field transfer function of a second acoustic near-field propagation channel between a second loudspeaker and a right ear of the listener;

filter a first input audio signal based on a first inverse of the first acoustic near-field transfer function to obtain a first output audio signal that is independent of a second input audio signal; and filter the second input audio signal based on a second inverse of the second acoustic near-field transfer function to obtain a second output audio signal ($X_R$) that is independent of the first input audio signal, wherein the first input audio signal and the second input audio signal are filtered according to the following equations:

$$X_L(j\omega) = \frac{E_L(j\omega)}{G_{LL}(j\omega)} \text{ and } X_R(j\omega) = \frac{E_R(j\omega)}{G_{RR}(j\omega)},$$

wherein $E_L$ denotes the first input audio signal, and $E_R$ denotes the second input audio signal, $X_L$ denotes the first output audio signal, $X_R$ denotes the second output audio signal, $G_{LL}$ denotes the first acoustic near-field transfer function, $G_{RR}$ denotes the second acoustic near-field transfer function, ω denotes an angular frequency, and j denotes an imaginary unit.

* * * * *